US009017149B2

(12) United States Patent
Mauer et al.

(10) Patent No.: US 9,017,149 B2
(45) Date of Patent: Apr. 28, 2015

(54) SURFACE TREATMENT DEVICE

(71) Applicants: Helmut H. Mauer, Shorewood, MN (US); Tim Bachman, St. Paul, MN (US); Jeffrey Popowski, Roseville, MN (US)

(72) Inventors: Helmut H. Mauer, Shorewood, MN (US); Tim Bachman, St. Paul, MN (US); Jeffrey Popowski, Roseville, MN (US)

( * ) Notice: Subject to any disclaimer, the term of this patent is extended or adjusted under 35 U.S.C. 154(b) by 0 days.

(21) Appl. No.: 14/259,572

(22) Filed: Apr. 23, 2014

(65) Prior Publication Data

US 2014/0315474 A1 Oct. 23, 2014

Related U.S. Application Data

(60) Provisional application No. 61/815,136, filed on Apr. 23, 2013.

(51) Int. Cl.

| | |
|---|---|
| ***B24D 15/00*** | (2006.01) |
| ***B24D 15/02*** | (2006.01) |
| ***B24D 15/04*** | (2006.01) |

(52) U.S. Cl.

CPC ..... *B24D 15/023* (2013.01); *B24D 15/045* (2013.01)

(58) Field of Classification Search

USPC ..... 451/523, 524, 525, 538, 539; 2/159, 2/160, 161.1, 161.6, 161.8; 15/227

See application file for complete search history.

(56) References Cited

U.S. PATENT DOCUMENTS

| | | | | |
|---|---|---|---|---|
| 2,163,025 | A * | 6/1939 | Dobkowitz | 451/461 |
| 2,256,098 | A * | 9/1941 | Mauldin | 451/516 |
| 2,804,729 | A * | 9/1957 | Dahlstrom | 451/503 |
| 3,151,333 | A * | 10/1964 | Scholz | 2/161.8 |
| 3,643,386 | A * | 2/1972 | Grzyll | 451/523 |
| 3,748,792 | A | 7/1973 | Lamb | |
| 3,885,249 | A * | 5/1975 | De Brabander | 15/227 |
| 4,038,787 | A * | 8/1977 | Bianchi | 451/523 |
| 4,202,139 | A * | 5/1980 | Hong et al. | 451/524 |
| 4,621,388 | A * | 11/1986 | Ortolivo | 15/227 |
| 5,885,148 | A | 3/1999 | Vargas | |
| 6,018,837 | A * | 2/2000 | Andreu | 15/118 |
| 6,098,234 | A * | 8/2000 | Jackson, Jr. | 15/118 |
| 6,557,178 | B1 * | 5/2003 | Hoover | 2/161.6 |

(Continued)

FOREIGN PATENT DOCUMENTS

| | | |
|---|---|---|
| CA | 2432367 A1 | 12/2003 |
| GB | 2391499 A | 2/2004 |

OTHER PUBLICATIONS

Saint-Gobain Abrasives, Inc., Norton 3X Sanding Glove Sponge; Accessed Feb. 4, 2013; Published online at http://mitchellsabrasives.com/osc/product_info.php?cPath=27&products_id=80.

(Continued)

*Primary Examiner* — Eileen P. Morgan

(74) *Attorney, Agent, or Firm* — Adams Grumbles, LLP; Brittany Nanzig

(57) ABSTRACT

A device used to smooth a material's surface with abrasion. More specifically, the device is in the form of a glove or mitten with an abrasive layer that is placed over, and secured on, a user's hand to protect the user's hand and to provide an agile and flexible range of motion while sanding a material's surface.

11 Claims, 40 Drawing Sheets

(56) References Cited

U.S. PATENT DOCUMENTS

| | | | | |
|---|---|---|---|---|
| 6,575,822 | B2 * | 6/2003 | Lowe et al. | 451/526 |
| 6,604,244 | B1 * | 8/2003 | Leach | 2/161.6 |
| D479,972 | S * | 9/2003 | Cueto | D8/90 |
| 6,912,731 | B2 * | 7/2005 | Cass | 2/161.1 |
| D526,180 | S | 8/2006 | Holden | |
| 7,874,020 | B1 * | 1/2011 | Franklin | 2/160 |
| 8,062,101 | B1 | 11/2011 | Friend | |
| D660,673 | S | 5/2012 | Weatherby | |
| 2002/0009966 | A1 | 1/2002 | Orr | |
| 2004/0063390 | A1 * | 4/2004 | Codd | 451/523 |
| 2006/0211352 | A1 | 9/2006 | Adams | |
| 2007/0087674 | A1 * | 4/2007 | Cox | 451/526 |
| 2008/0090506 | A1 * | 4/2008 | Palushaj | 451/538 |
| 2008/0276395 | A1 * | 11/2008 | Powell et al. | 15/143.1 |
| 2011/0053475 | A1 | 3/2011 | Meyer | |
| 2011/0183589 | A1 * | 7/2011 | Yu | 451/523 |
| 2012/0071070 | A1 * | 3/2012 | Powell et al. | 451/458 |
| 2013/0025023 | A1 * | 1/2013 | Anthony | 2/158 |

OTHER PUBLICATIONS

Kwh Mirka; Abranet Sanding Gloves; Accessed Feb. 4, 2013; Published online at http://powerhousebowling.com/products/product_detail/abranet_sanding_gloves.

Dynabrade Inc., DynaMitt sanding glove; Accessed Feb. 4, 2013; Pulished online at http://www.cabinetmakerfdm.com/Products/Dynabrade_Inc_sanding_glove.html.

Dynabrade Inc., DynaMitt Abrasive Sheets; Accessed Feb. 4, 2013; Published online at http://www.creativehardwarestore.com/finishing-sanding-and-glues/sanding/sanding-accessories/dynamitt-sanding-glove.html.

The Sanding Glove, The Sanding Glove; Accessed Feb. 4, 2013; Published online at https://thesandingglove.com/The-Sanding-Glove.asp.

* cited by examiner

SURFACE TREATMENT DEVICE

CROSS-REFERENCE TO RELATED APPLICATIONS

This application claims the benefit of U.S. Provisional Application Ser. No. 61/815,136, filed on Apr. 23, 2013, titled SURFACE TREATMENT DEVICE.

FIELD OF THE DISCLOSURE

The present disclosure related to a wearable device that fits on a user's hand and that is used to more easily smooth a material's surface by sanding.

BACKGROUND OF THE INVENTION

The surfaces of wood, fiberglass and other construction materials often require sanding to function well for constructing objects, structures, and supports. This is most significant for surfaces that need to be painted or sealed or that will be in regular physical contact (with skin, clothing, etc.). Creating a smooth surface is a simpler task when sanding is performed on flat surfaces, such as wooden boards or walls. However, there are many uses of the above materials that involve curved or angled surfaces that are more difficult to sand. With these forms of materials, flat sandpaper or sand blocks may be difficult to employ. The problem is compounded when the sanding work requires pressure from individual fingers or groups of fingers to keep in efficient contact with the surface. This type of usage of sandpaper can stress or abrade a user's fingers and can cause a user's skin to come in contact with rough surfaces or splinters. Fiberglass shards or splinters present a unique concern in this regard.

As a further problem, surfaces, whether curved or flat, may be difficult to reach or otherwise inaccessible by standard sandpaper or sand blocks. For example, in boat construction, all wood surfaces, inside or out, must be fully sanded and sealed to inhibit salt damage and rot. However, given the tight geometries of boat segments or areas, sanding usually requires lengthy, difficult and painful detail work with finger pressure, sometimes without clear view.

SUMMARY OF THE INVENTION

To address the foregoing and other related issues of sanding efficiency and safety, disclosed herein is a device that provides protection for, and agile and flexible motion by, a user's hand and fingers, and has a modular design including the use of different inserts and attachments to allow for sanding or other hand motion applications in multiple configurations and for multiple purposes.

The present disclosure relates to a device to facilitate the action of smoothing a material's surface by sanding the surface. The sanding device is in the form of a glove or mitten to be placed over a user's hand and fingers to provide protection to the user's hand and fingers, but is configured so as to allow the user to maintain an agile and flexible range of motion while sanding a material's surface. In some embodiments, the device can further be used to facilitate cleaning of a surface by replacing the abrasive sandpaper sheet used in conjunction with the device with a piece of fabric or other material. In some embodiments, the device is secured around the hand and fingers of the user by way of one or more closure straps. In some embodiments, the device is further secured around the hand and fingers of the user by way of an elastic wristband.

DETAILED DESCRIPTION

Figure 1:
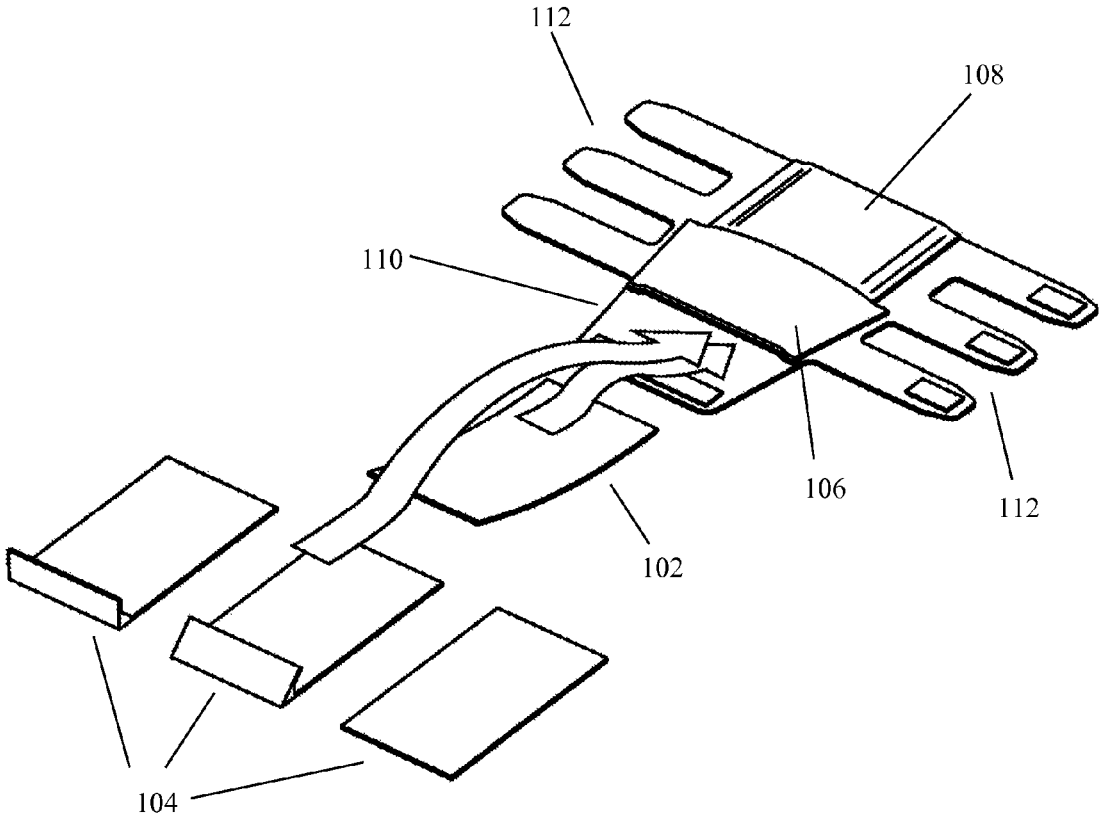
FIG. 1 is a front right perspective view of one embodiment of the device, wherein the device includes a flexible base, at least one insert pad, at least one rigid edge insert, a fingertip pocket, an undersleeve, an adjustable folding flap, and at least one closure strap.

The sanding device disclosed herein is described by reference to the text and figures below. Various embodiments will be described in detail with reference to the drawings, wherein like reference numerals represent like parts and assemblies throughout the several views. Reference to various embodiments does not limit the scope of the claims attached hereto. Additionally, any examples set forth in this specification are not intended to be limiting and merely set forth some of the many possible embodiments for the appended claims. It is understood that various omissions and substitutions of equivalents are contemplated as circumstances may suggest or render expedient, but these are intended to cover applications or embodiments without departing from the spirit or scope of the claims attached hereto. Also, it is to be understood that the phraseology and terminology used herein are for the purpose of description and should not be regarded as limiting.

In one embodiment, a sanding or cleaning device is worn and controlled by a user's left or right hand, providing precise control during sanding or cleaning activities via the use of a combination of rigid and soft inserts, or rather via the natural shape of the hand, for example, when sanding or cleaning hard to see and reach, uniquely shaped surfaces, or performing fine, detailed woodworking. Because the user's whole hand is used to control the sanding device, rather than just the user's fingers, pressure is better spread out, yielding a smoother, flatter surface as the end product. The device is a product that is, in the preferred embodiment, made of water- or salt-resistant materials and treated fabrics. These materials can include spandex, neoprene, treated or untreated nylon, foam, rubber, or plastic. Other materials may work as well in other embodiments. In some embodiments the materials used may be waterproof or water-resistant, while in other embodiments the materials may not be resistant to water. The device may in whole or in part be made of a flexible material, such as elastic fabric, that is stretchable in order to fit the form of a user's hand.

The user's hand is inserted or placed into the device through an open end portion, with the palm of the user's hand lying on top of the lower portion of the device. The lower portion of the device may be of a shape that is roughly rectangular. In one embodiment, the user's hand is positioned under one or more closure straps that are wrapped across the top part of the hand and secured to affix the user's hand within the device and minimize abrasion of the hand against the inside of the device. The securing of the closure straps can be achieved in various ways, including hook and loop straps, a rigid buckle option providing folding, adjustable closure, or by an elastic wrist band to naturally seal around the entire hand at the wrist. Any securing method that causes the glove to fit snugly to the hand will suffice.

In one embodiment, the device itself is an enclosure so that when a user inserts his or her hand, the hand is positioned within the entirety of the device. In one embodiment of the enclosed version of the device, the user's hand may be secure inside the device because the device itself is made of elastic material that fits snuggly onto a user's hand. In one embodiment of the enclosed version of the device, the user's hand may be secure inside the device, or made comfortable, due to a compression-molded base that conforms to the shape of a user's hand. In another embodiment of the enclosed version of the device, the user's hand may be secure inside the device due to an elastic band that wraps around the device and secures it to the user's hand. In another embodiment, the user's hand may be secure inside the device through the use of a laced pull system or a strap in addition to the enclosure that tightens the device, similar to how a shoe may be secured to a foot. In a further embodiment, the device may have a thumbhole on the side to enable a tighter fit of the device to the user's hand. In one embodiment, the device may resemble a fingertip glove and conform to the end of a user's hand instead of the user's entire hand.

Figure 4:
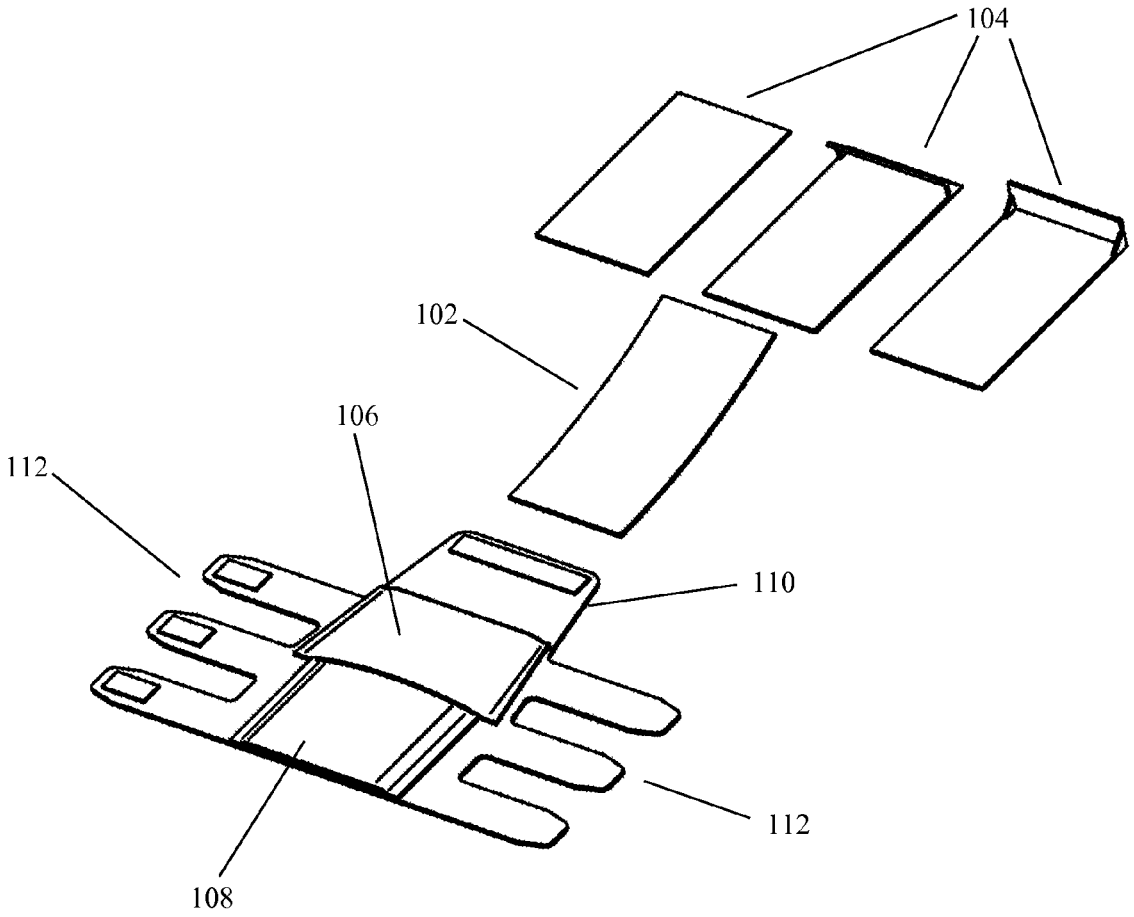
FIG. 4 is a back right perspective view of the device of FIG. 1.
Figure 44:
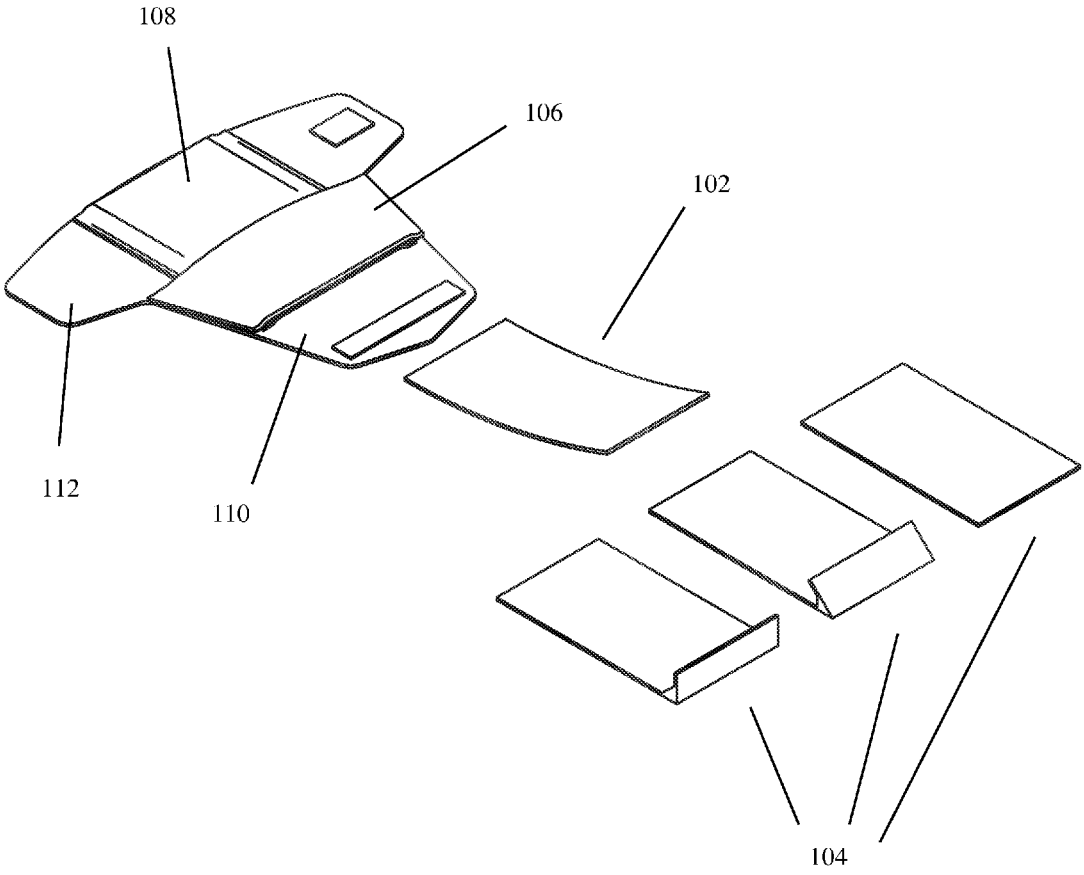
FIG. 44 is a front left perspective view of one embodiment of the device, wherein the device includes a flexible base, at least one insert pad, at least one rigid edge insert, a fingertip pocket, an undersleeve, an adjustable folding flap, and one closure strap
Figure 46:
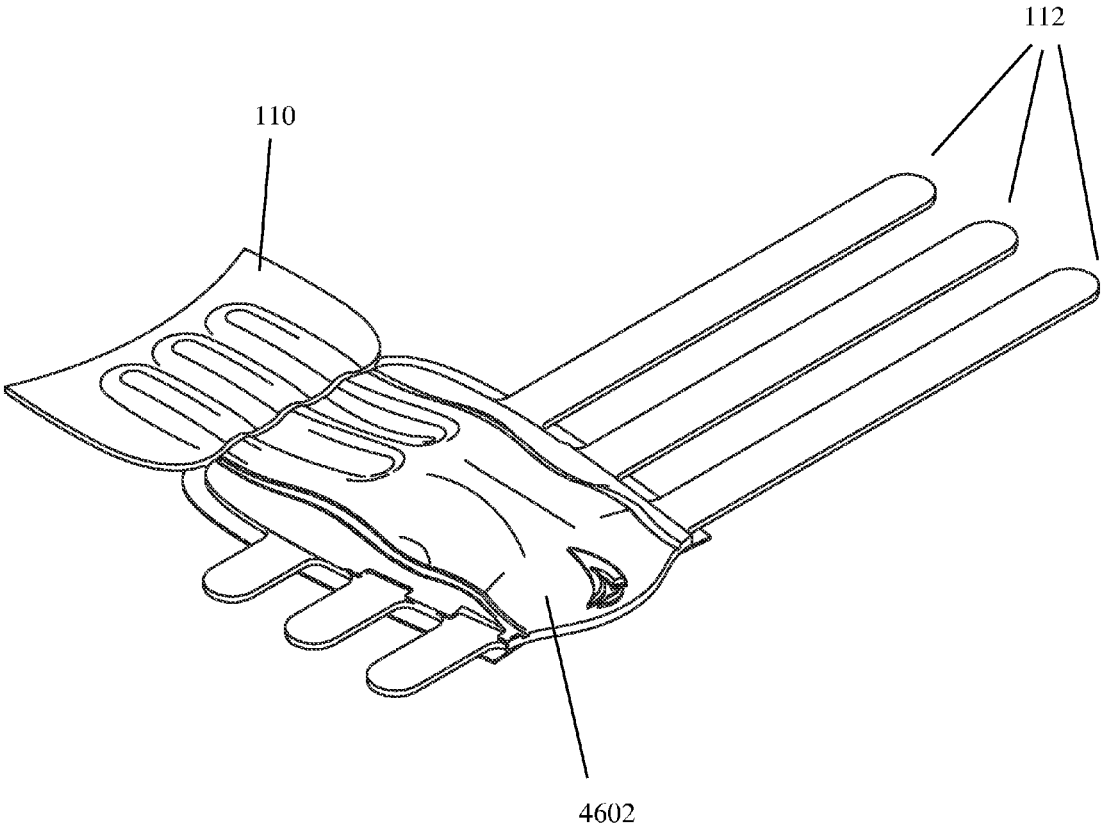
FIG. 46 is a back left perspective view of one embodiment of the device, wherein the device includes a flexible base, a raised pad and grip area, an adjustable folding strap, and at least one closure strap.
Figure 47:
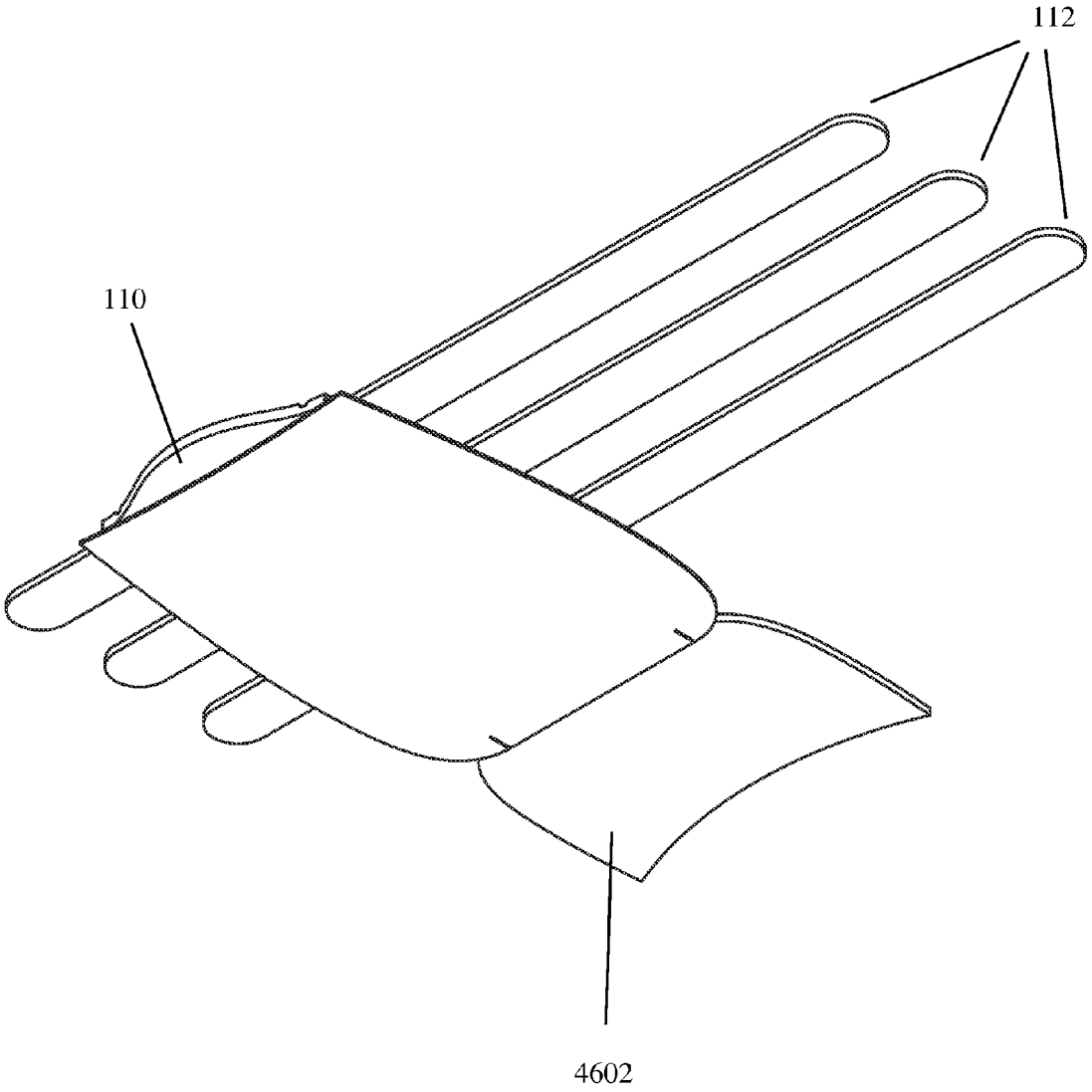
FIG. 47 is a back right bottom perspective view of the device of FIG. 46.

Referring to FIGS. 1 and 44, in one embodiment, the device is multi-layered, and is comprised of a flexible base (not numbered), at least one insert pad 102, at least one rigid edge insert 104, a fingertip pocket 106, an undersleeve 108, an adjustable folding flap 110, and at least one closure strap 112. An alternate view of these components of the device is shown in FIG. 4. An alternative form of the device has a molded pad and grip area 4602 for the palm and fingers in place of a fingertip pocket 106 and undersleeve 108, as illustrated in FIGS. 46 and 47. The fingertip pocket 106 is located at the forward edge of the device, and is configured to receive the fingers of a user. The pocket 106 protects the fingers and permits precise control of sanding. In one embodiment, the pocket 106 is flat across the end and roughly rectilinear to the side portions of the device.

Adjacent to or beneath the pocket 106 is an aperture or undersleeve 108 configured to receive an optional insert pad 102. The insert pad 102 can be flat, and can have an end portion that is rectilinear to the flat portion or an end portion that is at an angle. In some embodiments, the device does not include the pocket 106 or the aperture/undersleeve 108, but alternatively the insert pad 102 and/or rigid edge insert 104 are sealed within the flexible base of the device and are an integral, non-removable part of the device.

The insert pad 102 may be of varying densities and rigidities to help unify sanding pressures across the desired surface. The insert pad 102 can be rigid or flexible or some combination thereof. The insert pads 102 can be made of various materials depending on desired rigidity. For example, the insert pad 102 may be made of soft, compressible foam or low durometer rubber, 30-60 Shore A. In some embodiments, the insert pad 102 may be made of plastic, metal or wood, or may be made of polyurethane foam.

Figure 15:
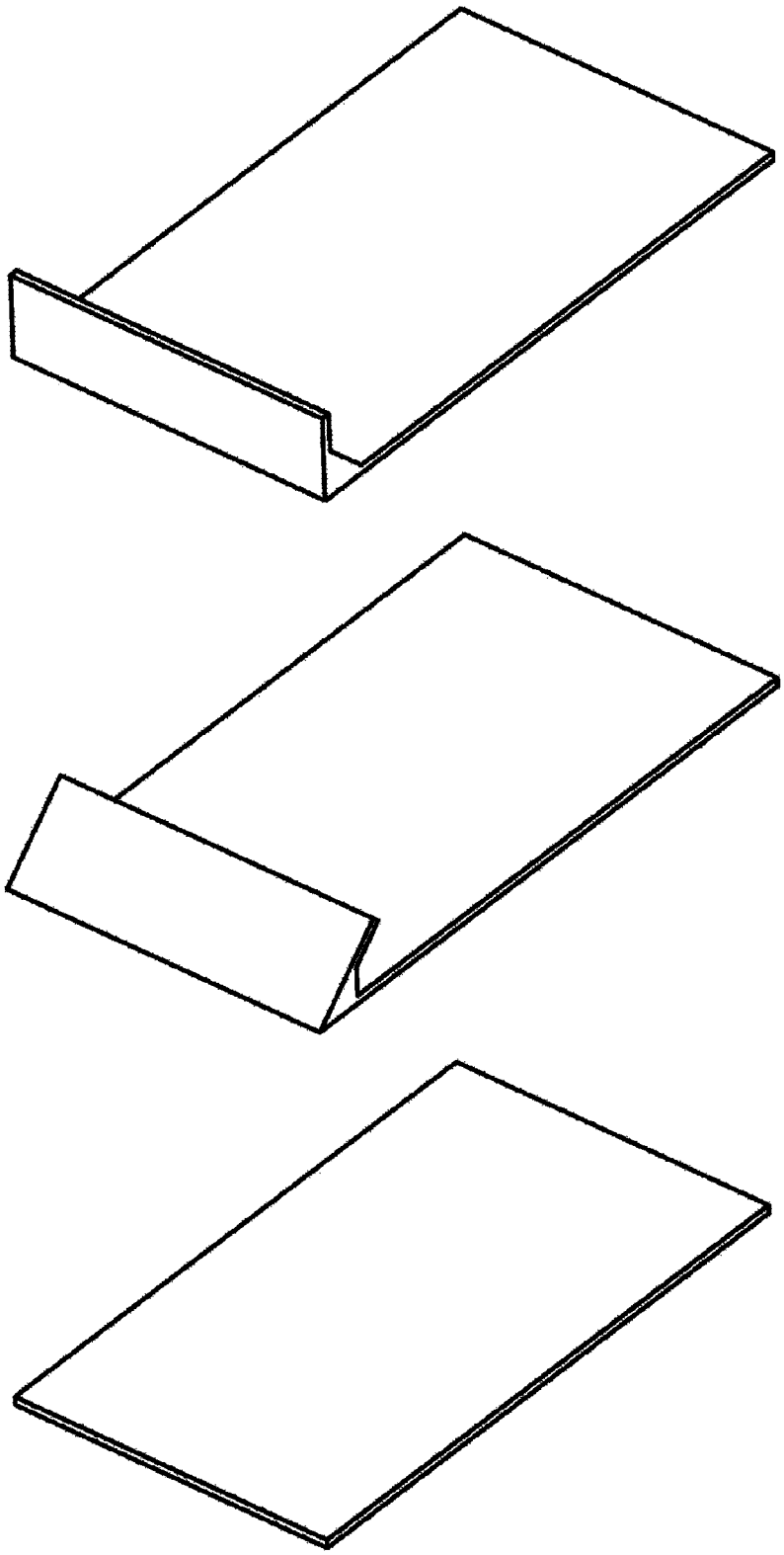
FIG. 15 is an illustration of three possible configurations of the rigid edge insert of the present invention.

The aperture or undersleeve 108 may further be configured to receive an optional rigid edge insert 104 to provide a controlled leading sanding edge to the device. The rigid edge insert 104 may be of varying shapes and materials. For example, the rigid edge insert 104 may be made of plastic, metal or wood, and may have an edge that is flat, or may have an edge with a 45 or 90 degree profile, as illustrated in FIGS. 1, 4, and 15. The angled portion of the insert can vary based on the surface that will be sanded. For example, sanding in a corner or other narrow spot might require an insert 104 with an angled end portion. In some embodiments, the insert pad 102 and rigid edge insert 104 may be received by the aperture or undersleeve 108 both at the same time. In some embodiments, only one of the insert pad 102 or the rigid edge insert 104 may be received by the aperture or undersleeve 108 at any given time.

Figure 2:
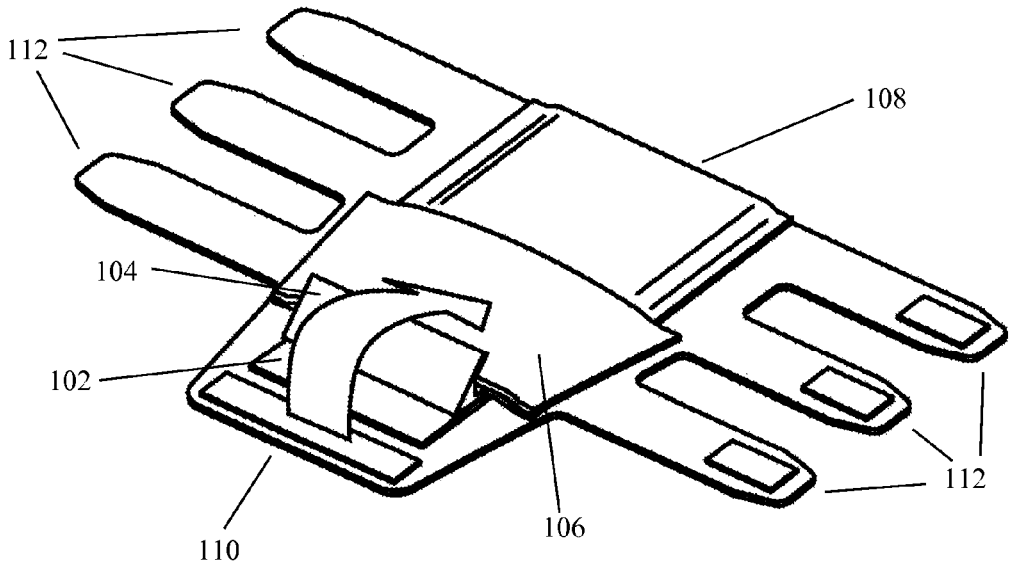
FIG. 2 is a front right perspective view of the device of FIG. 1.
Figure 3:
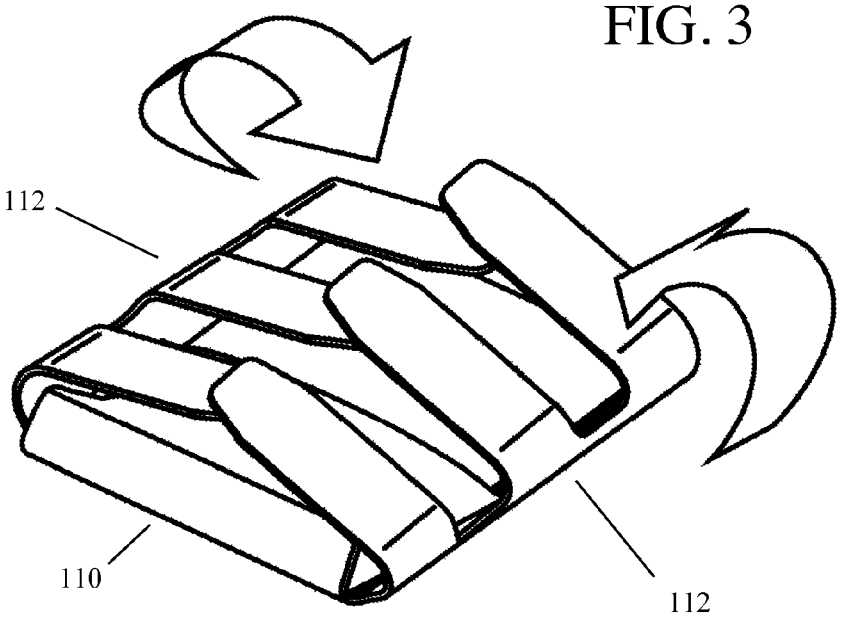
FIG. 3 is a front right perspective view of the device of FIG. 1.
Figure 5:
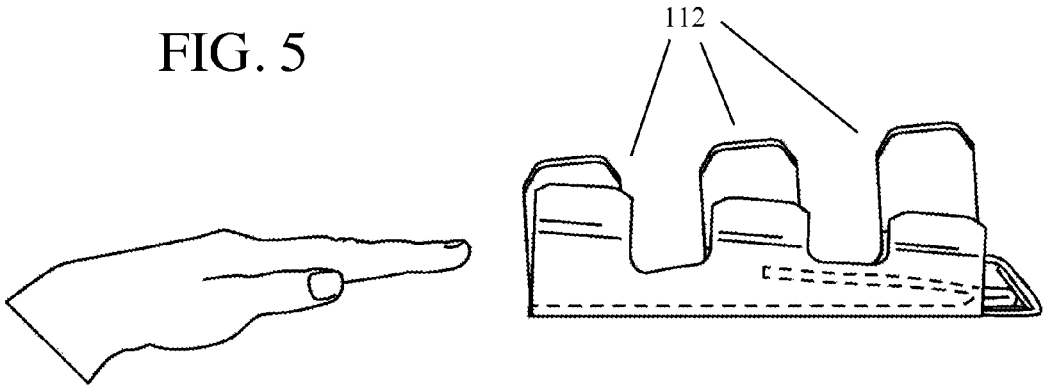
FIG. 5 is a right side orthographic view of the device of FIG. 1, showing the placement of a user's hand according to one embodiment.
Figure 6:
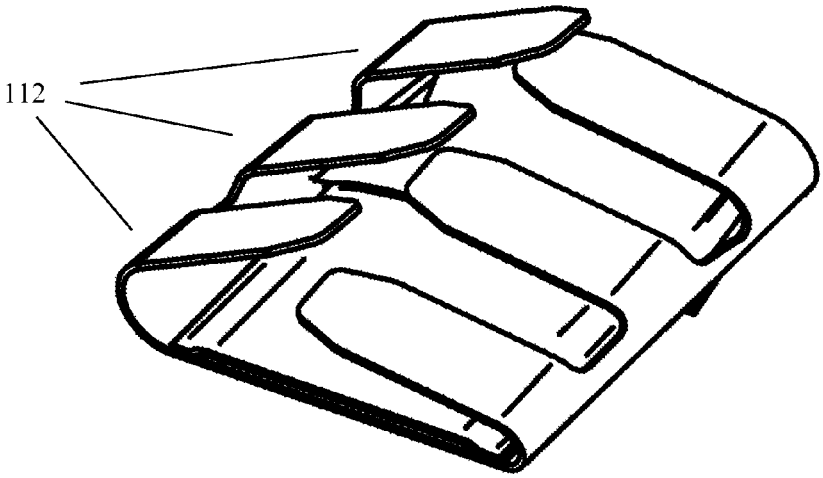
FIG. 6 is a front right perspective view of the device of FIG. 1.

The device further includes an adjustable folding flap 110 configured at the leading edge of the device, and further configured to wrap the sanding surface of the device fully around the leading edge of the device. As illustrated in FIG. 2, once the optional insert pad 102 and/or optional rigid edge insert 104 have been inserted into the aperture or undersleeve 108, the adjustable folding flap 110 is wrapped around the edge of the insert(s) to contain the edge. The at least one closure strap 112 is then folded over the upper portion of the device to securely fix the device around the user's left or right hand, as illustrated in FIG. 3. An alternate view of the folded device is shown in FIG. 6. In the embodiments illustrated in FIGS. 1 through 14, and 19 through 24, the device includes three closure straps to provide a secure fit around the hand of the user. FIG. 5 is a right side orthographic view showing the fingertip pocket 106 and the placement of a user's hand within the pocket 106 and the device. In the embodiments illustrated in FIGS. 44 and 45, the device includes one closure strap to provide a secure fit around the hand of the user.

Alternative designs for the device are illustrated in FIGS. 25 through 47. In one embodiment, the device is primarily comprised of a single compression molded part, as illustrated in FIGS. 25 through 28. The device can have a raised pad and grip area 2502 to ensure a more snug fit with the hand and can also have an elastic wrist cover 2504 that secures the device to the user's hand. A rigid plate 2506, to which a surface treatment attachment or sanding surface 114 can be attached, can itself be attached to the base of the device.

Figure 29:
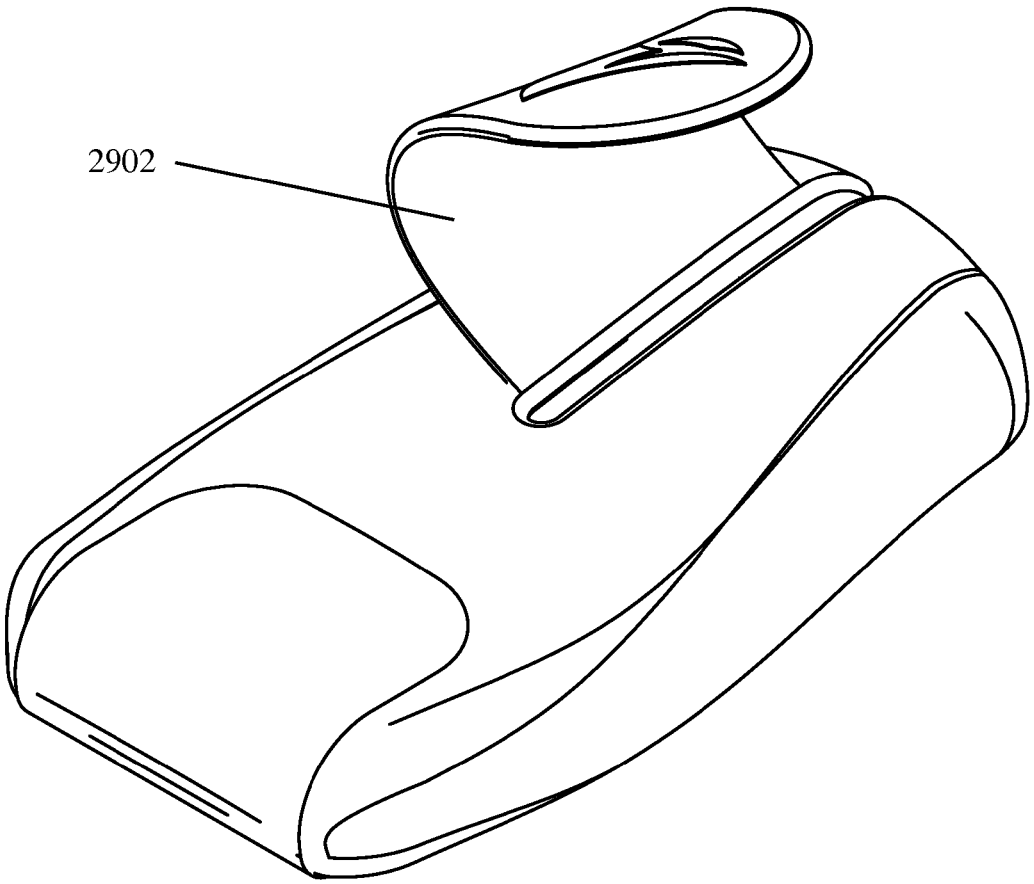
FIG. 29 is a front right perspective view of one embodiment of the device, wherein the device is in a mitten form and can be further secured using a hook and loop strap.
Figure 30:
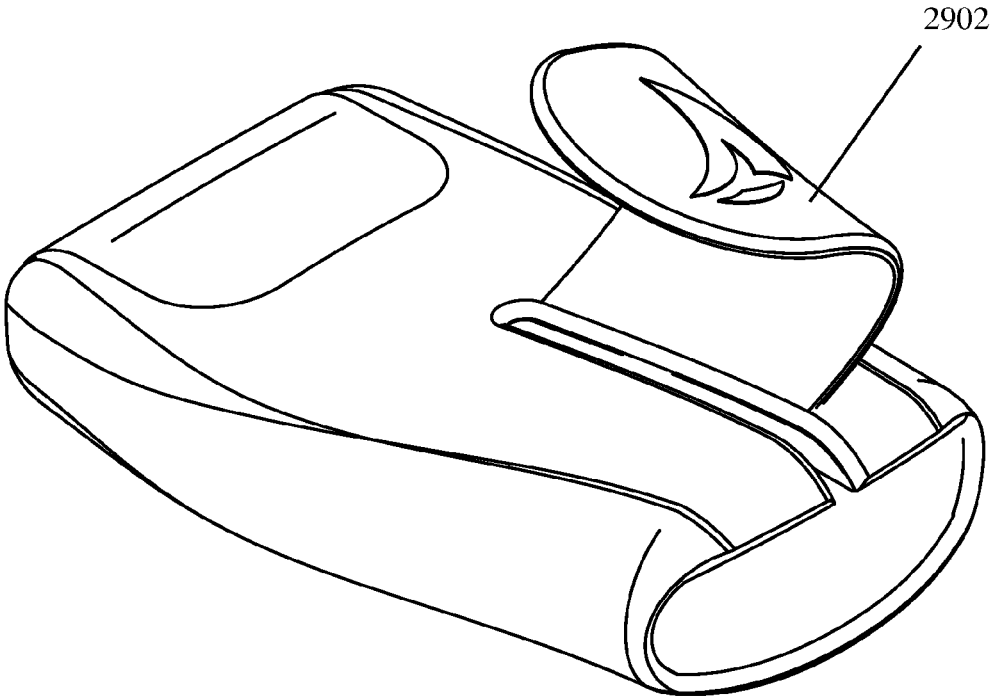
FIG. 30 is a back left perspective view of the device of FIG. 29.
Figure 31:
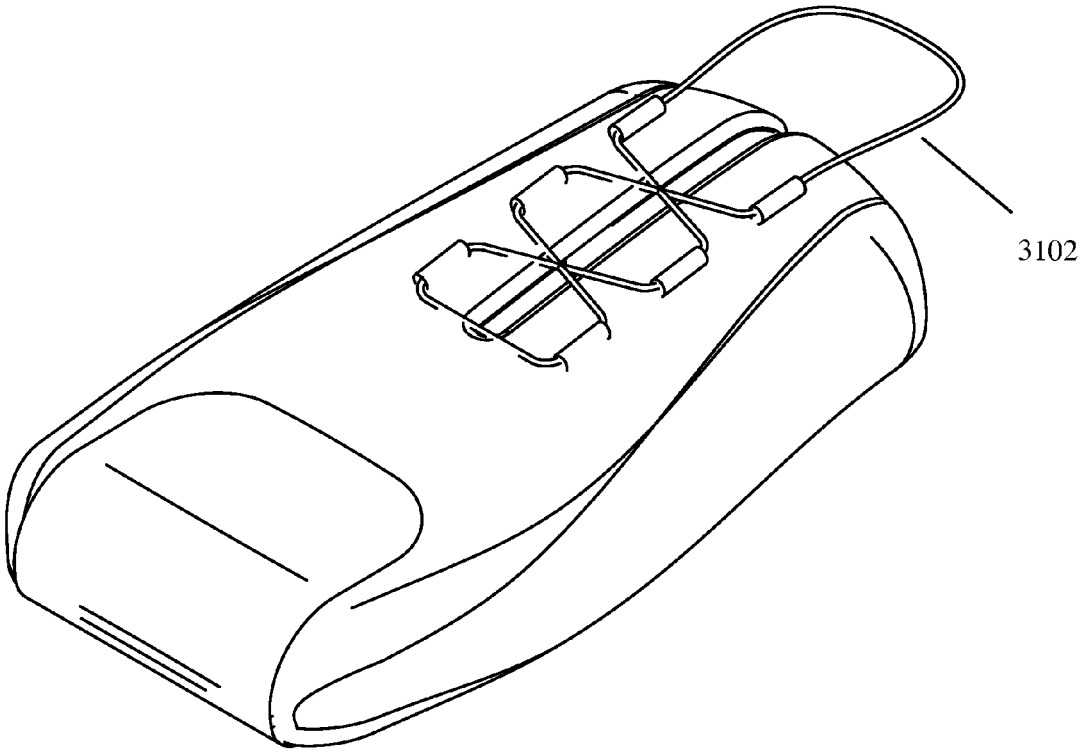
FIG. 31 is a front right perspective view of one embodiment of the device, wherein the device is in a mitten form and can be further secured using pull laces.
Figure 32:
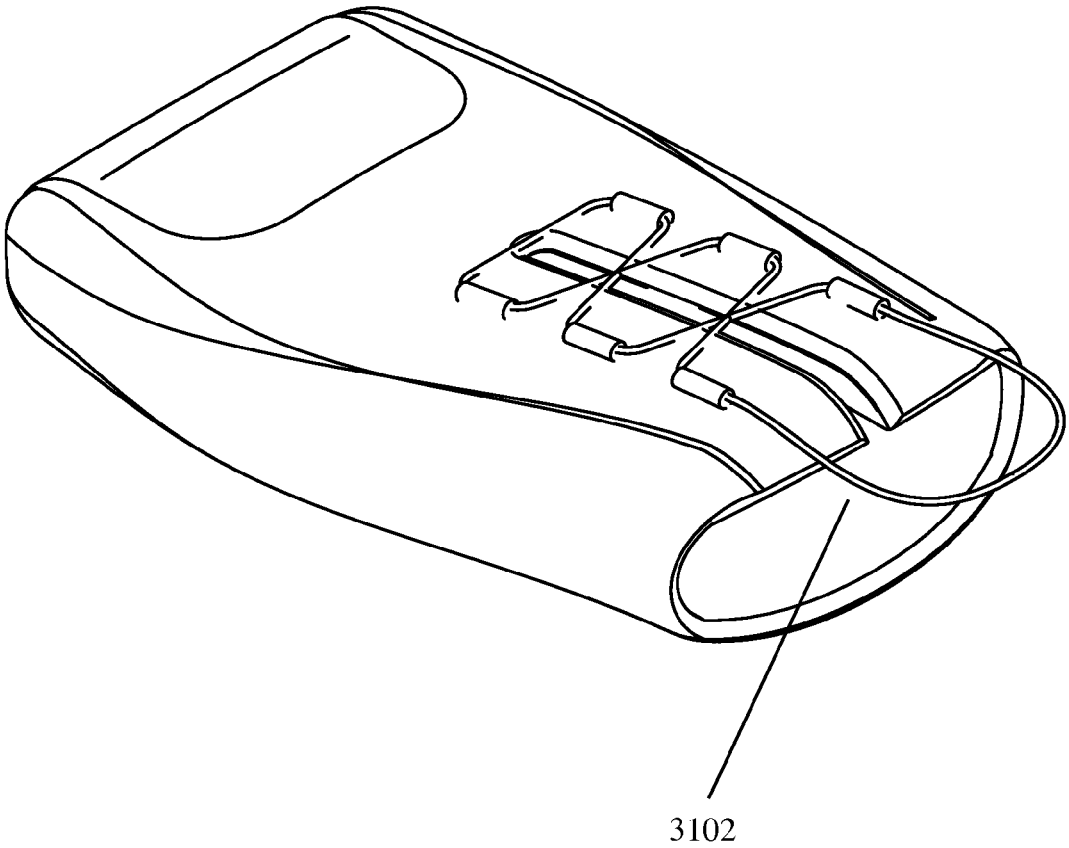
FIG. 32 is a back left perspective view of the device of FIG. 30.
Figure 33:
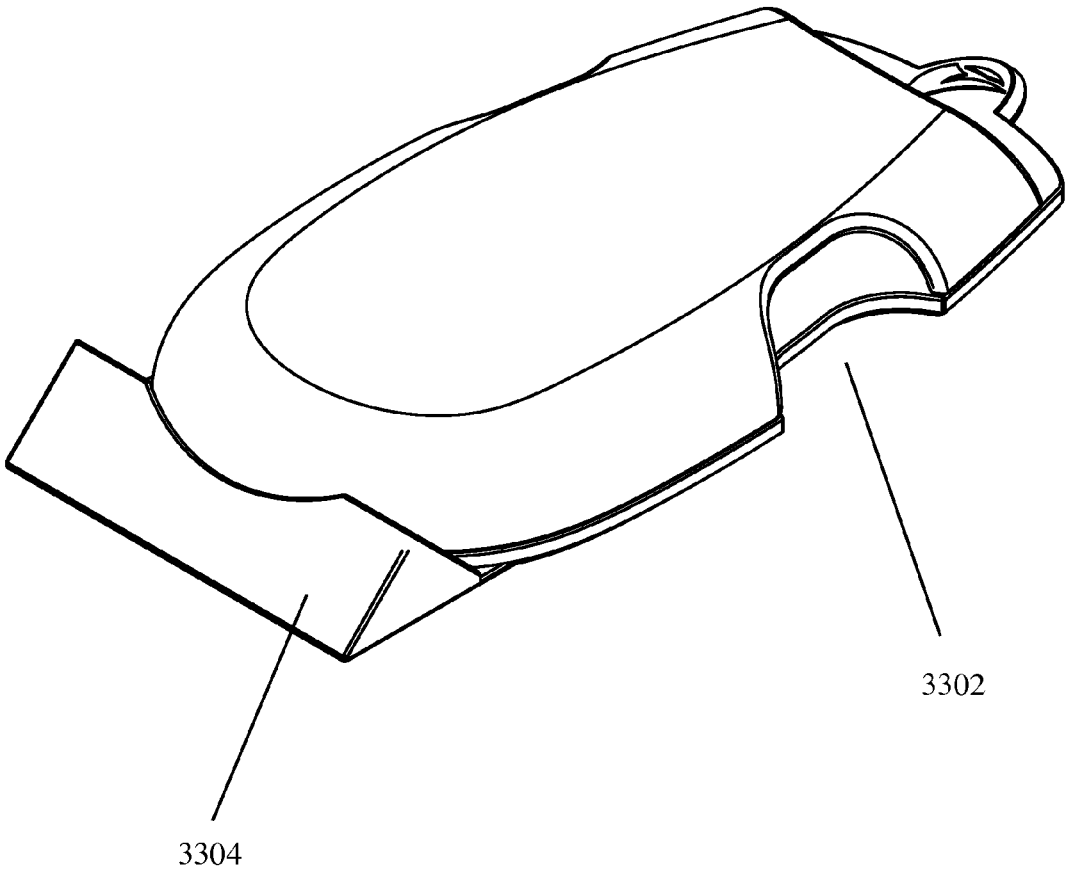
FIG. 33 is a front right perspective view of one embodiment of the device, wherein the device is in a mitten form, has at least one hole cut out of the side for the thumb, and has a folding rigid plate attached to the bottom.
Figure 34:
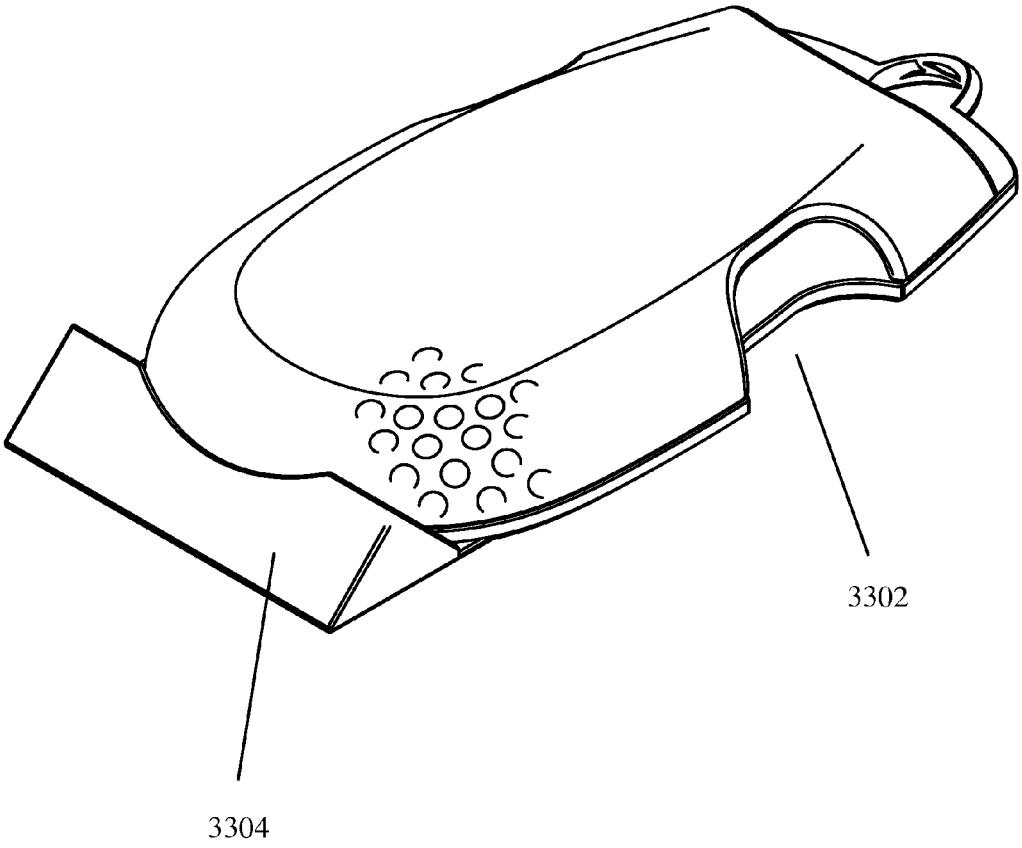
FIG. 34 is a front right perspective view of the device of FIG. 33, illustrating that the device may be porous on some or all of the surfaces.
Figure 35:
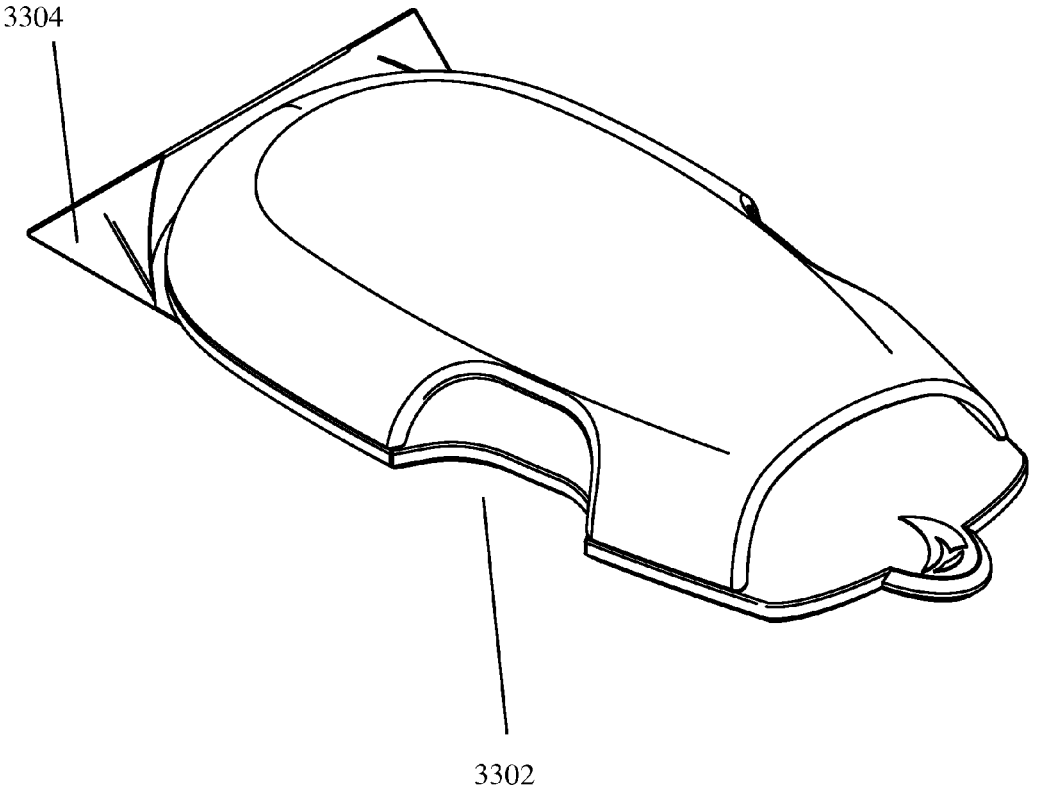
FIG. 35 is a back left perspective view of the device of FIG. 33.
Figure 36:
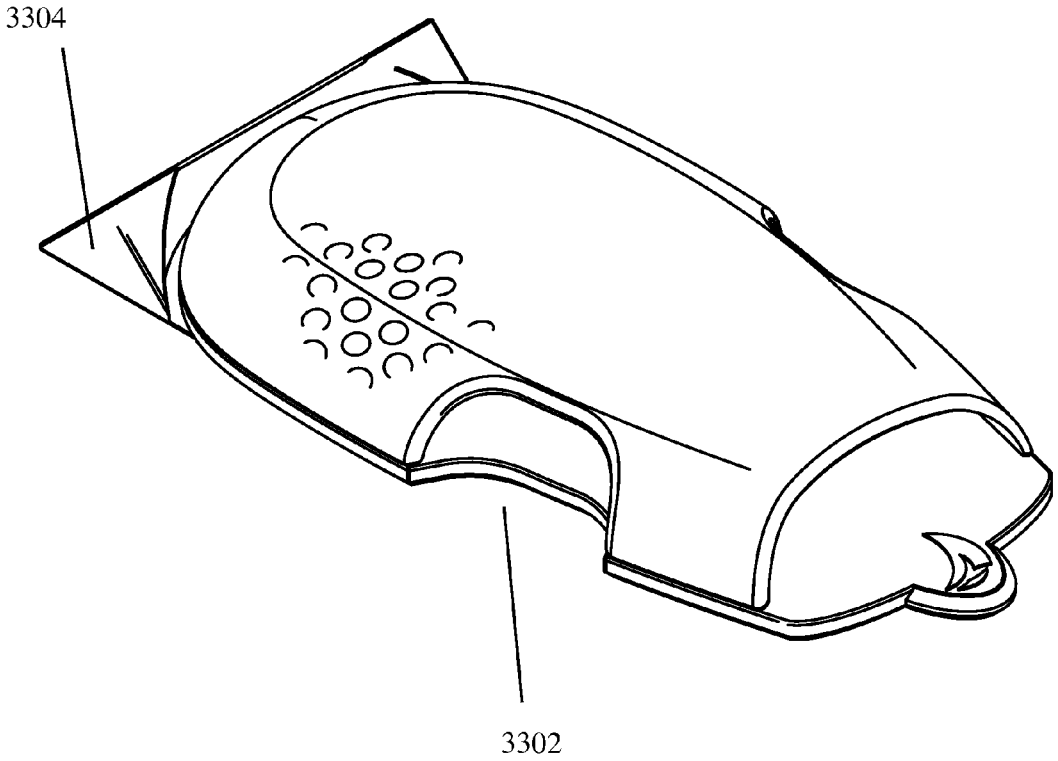
FIG. 36 is a back left perspective view of the device of FIG. 34.
Figure 37:
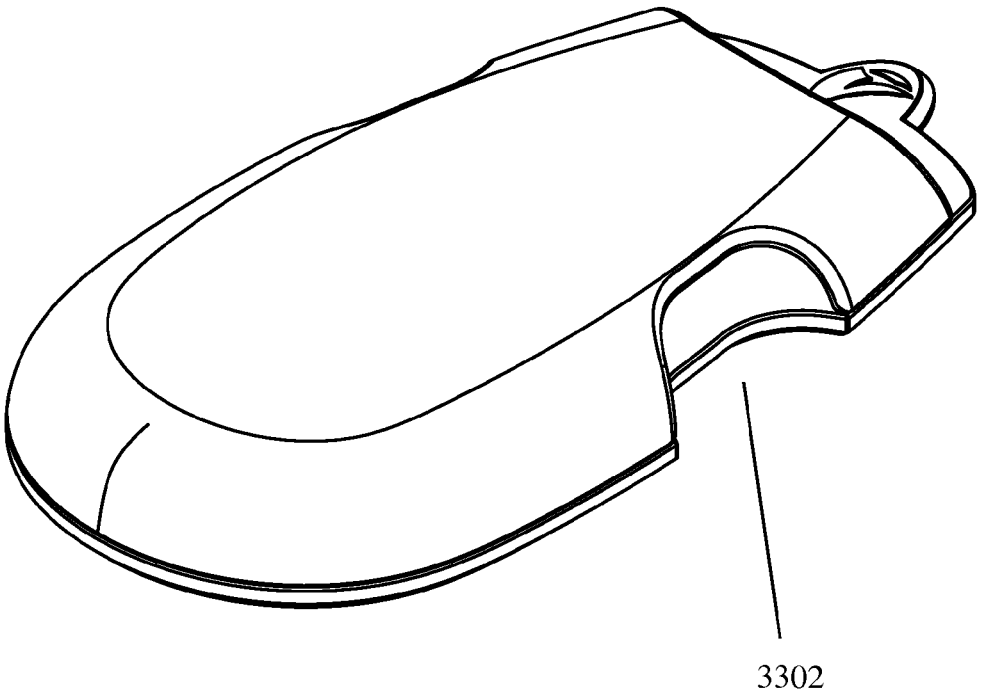
FIG. 37 is a front right perspective view of one embodiment of the device, wherein the device is in a mitten form and has at least one hole cut out of the side for the thumb.
Figure 38:
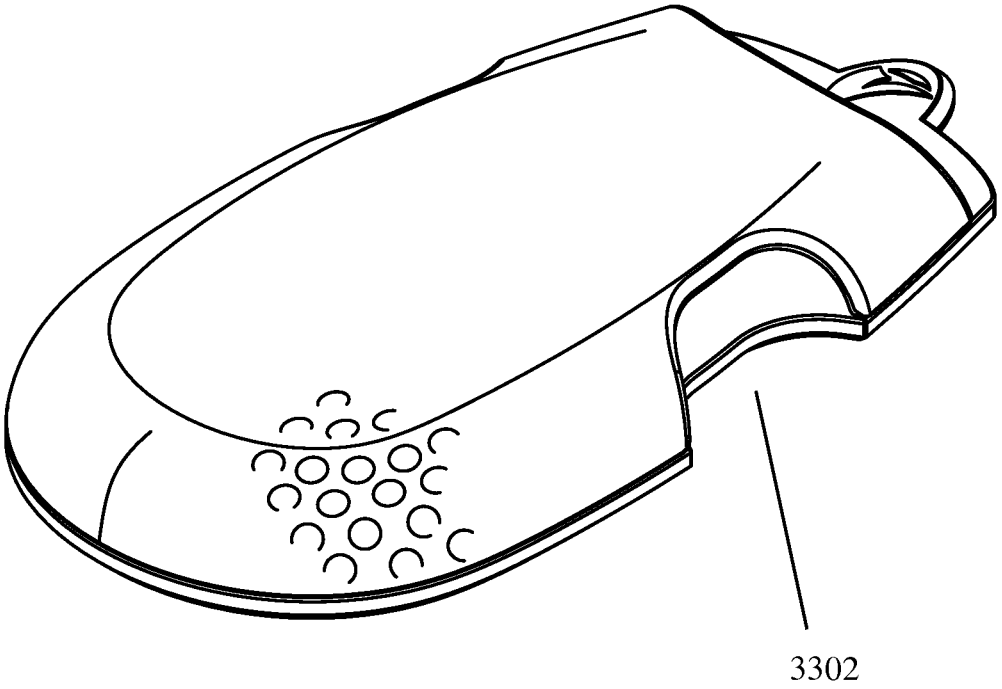
FIG. 38 is a front right perspective view of the device of FIG. 37, illustrating that the device may be porous on some or all of the surfaces.
Figure 39:
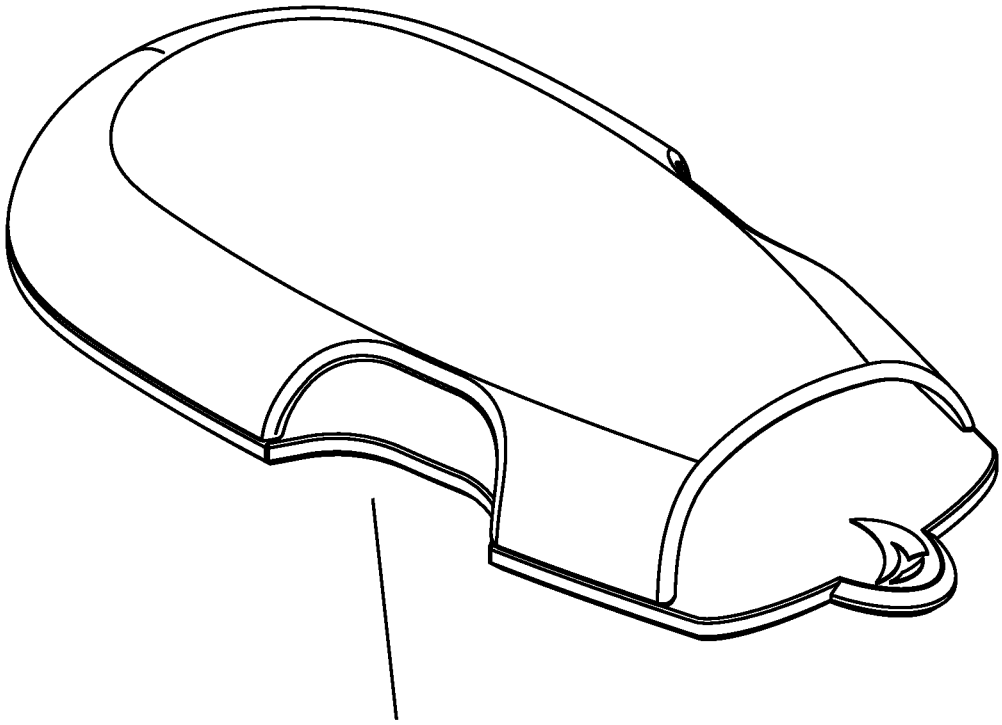
FIG. 39 is a back left perspective view of the device of FIG. 37.
Figure 40:
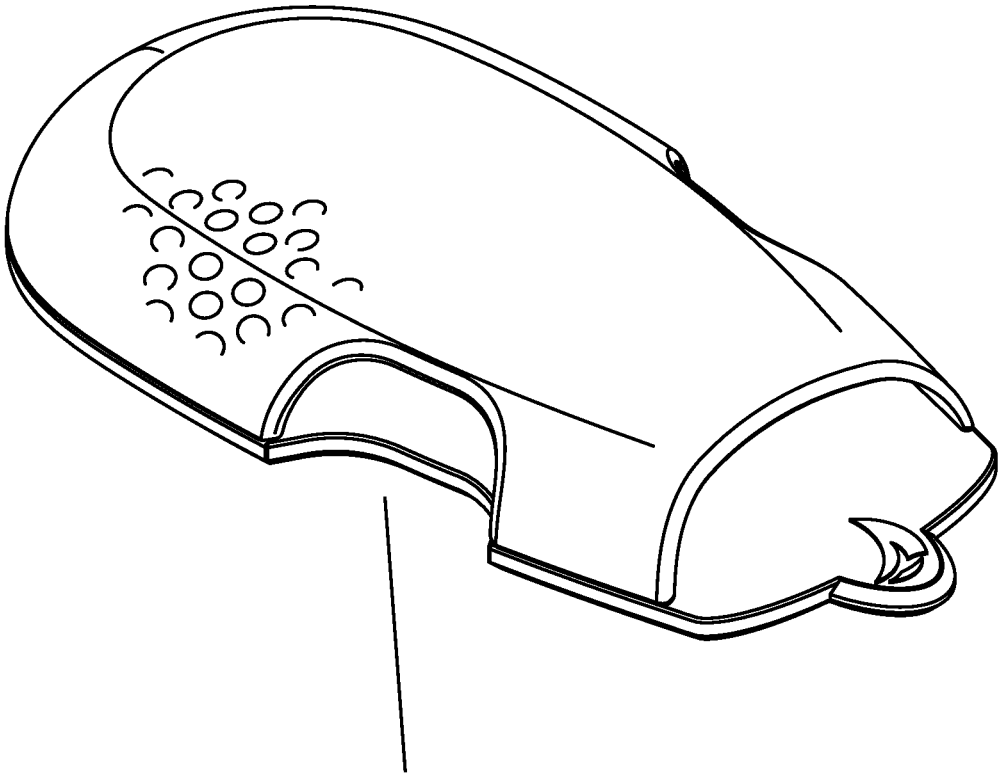
FIG. 40 is a back left perspective view of the device of FIG. 38.

In one embodiment, the device may exist in a flat mitten form, as illustrated in FIGS. 29 through 32. In this embodiment, the base of the device may be comprised of compression-molded parts to ensure a more snug fit. Further, the device may be secured even tighter to a user's hand through the user of a tab 2902 that attaches to the outside of the device through the use of a hook and pull attachment or buckle, as illustrated in FIGS. 29 and 30, or by pull laces 3102, as illustrated in FIGS. 31 and 32. The device can contain a rigid insert inside the layers of the fabric to achieve a flat bottom. Additionally, a folding, rigid plate 2506 may be affixed to the bottom. A surface treatment attachment or sanding surface 114 can be attached to either the rigid bottom or the rigid plate 2506. Further, a surface treatment attachment or sanding surface 114 may be able to wrap around the front of the device so the user can apply the surface treatment attachment or sanding surface 114 against a surface using the tips of the user's fingers.

In one embodiment, the device may be in the shape of a mitten with at least one thumbhole 3302, as illustrated in FIGS. 33 through 40. In some embodiments, as illustrated in FIGS. 34, 36, 37, and 40, some or all of the surfaces on the device may be a breathable or porous material. This embodiment of the device will enable a wet device to dry and breathe easier. Thumbholes 3302 may exist on the sides of the device to provide a tighter fit to the fingers and hand, as well as more control by the user. The base of the device may attach to a molded, geometric insert 3304 to create a flat bottom. A surface treatment attachment or sanding surface 114 can attach to the molded, geometric insert 3304. Additionally, an edge attachment, such as, but not limited to, a knife blade, serrated edge saw-type blade, wire or fiber brush attachment, may be attached to the front of the molded, geometric insert 3304.

Figure 41:
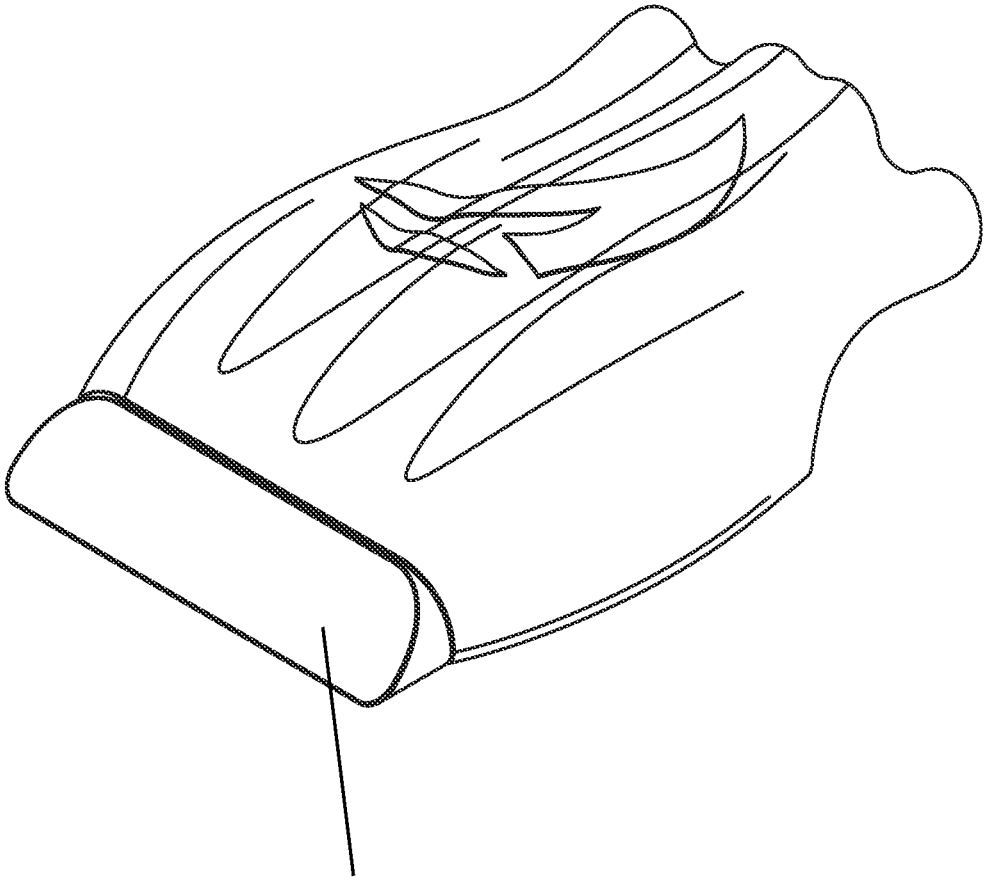
FIG. 41 is a front right perspective view of one embodiment of the device, wherein the device is made of a rigid plastic, is flat on the bottom, and includes an internal padded cushion and a molded, front piece.
Figure 42:
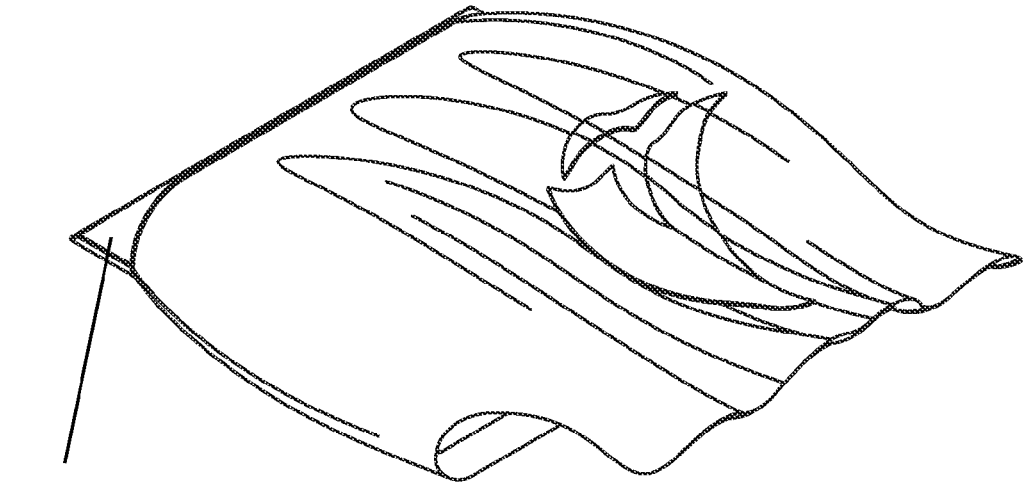
FIG. 42 is a back left perspective view of the device of FIG. 41
Figure 43:
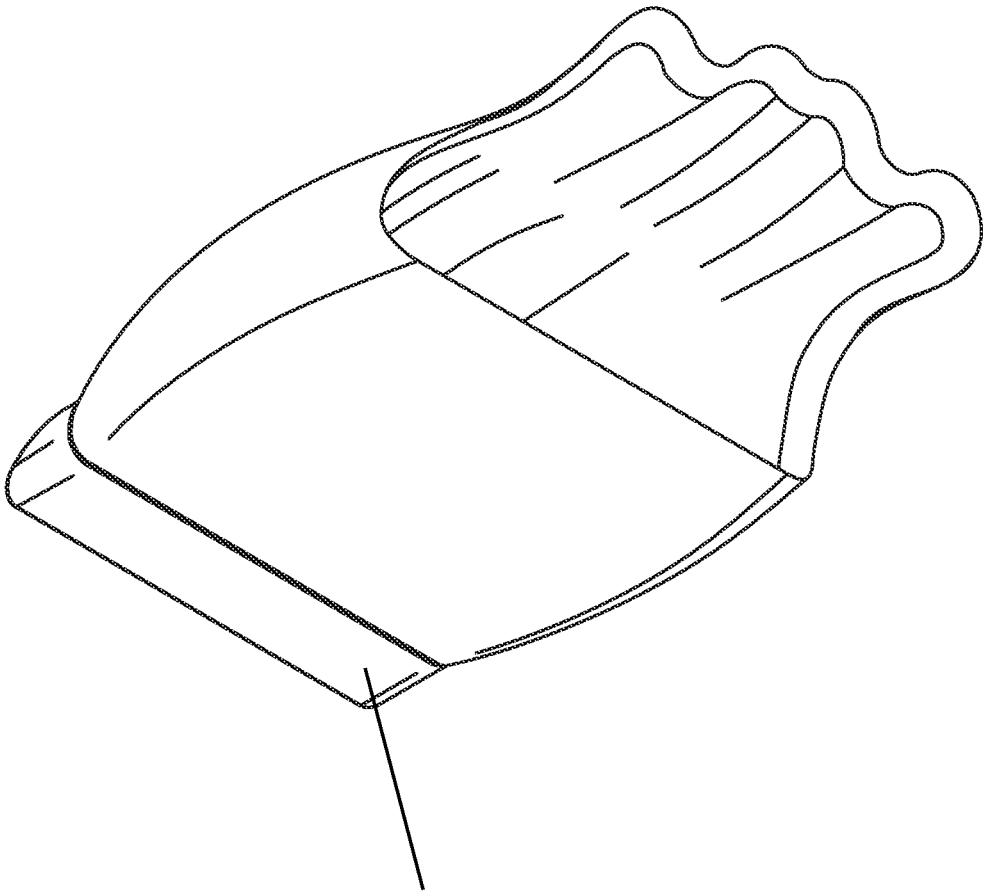
FIG. 43 is a bottom left perspective view of the device of FIG. 41.

In one embodiment, the device may be made of a rigid plastic that covers the fingertips and part of the palm and may be flat on the bottom, as illustrated in FIGS. 41 through 43. The device may include an internal padded cushion that provides a user with added grip. The device may also include a molded, front piece 4102 that tool attachments can attach to. Additionally, the device may have a thumb recess to enable a tighter fit to the fingers.

Figure 7:
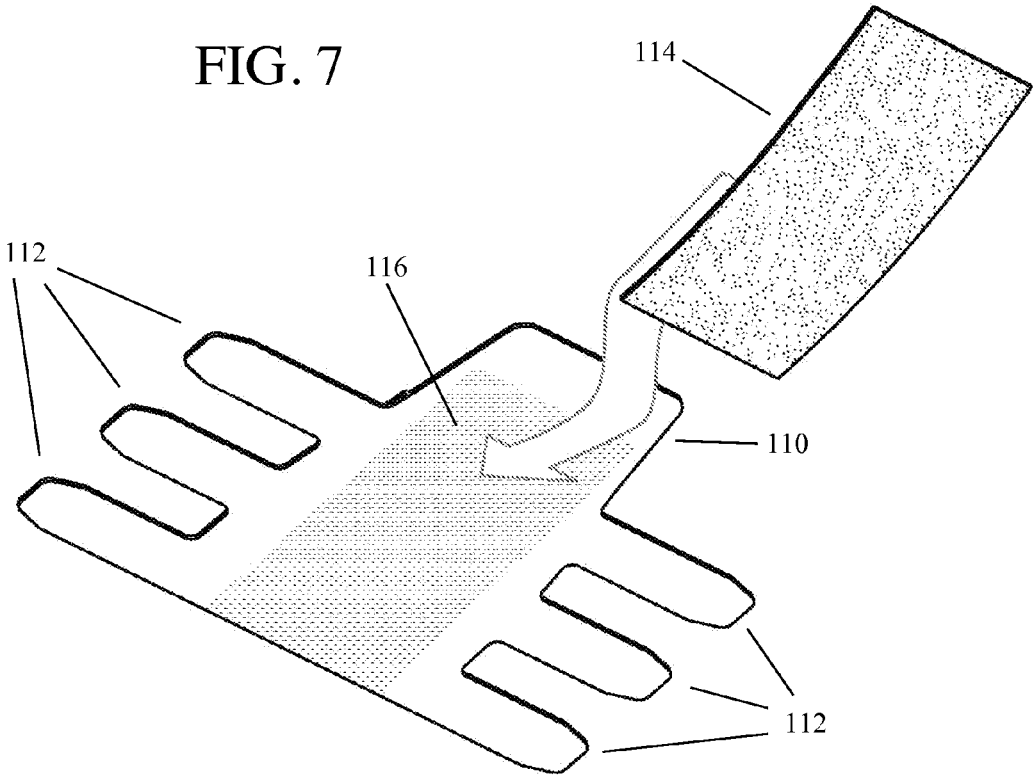
FIG. 7 is a bottom left perspective view of the device of FIG. 1.
Figure 8:
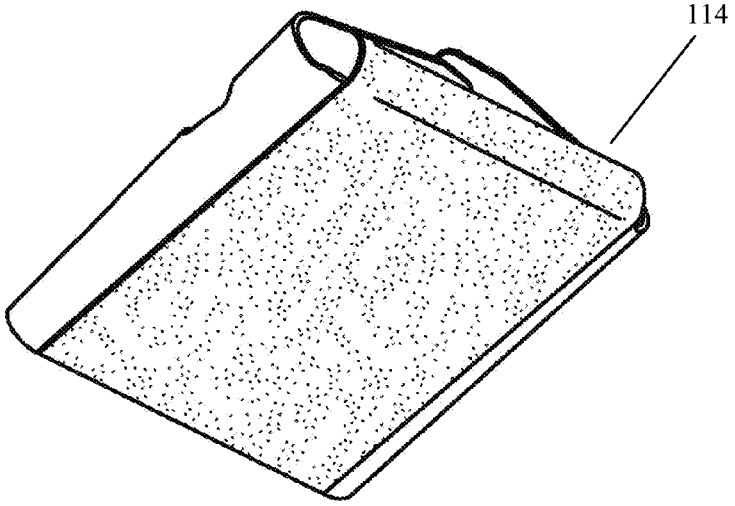
FIG. 8 is a bottom left perspective view of the device of FIG. 1.
Figure 9:
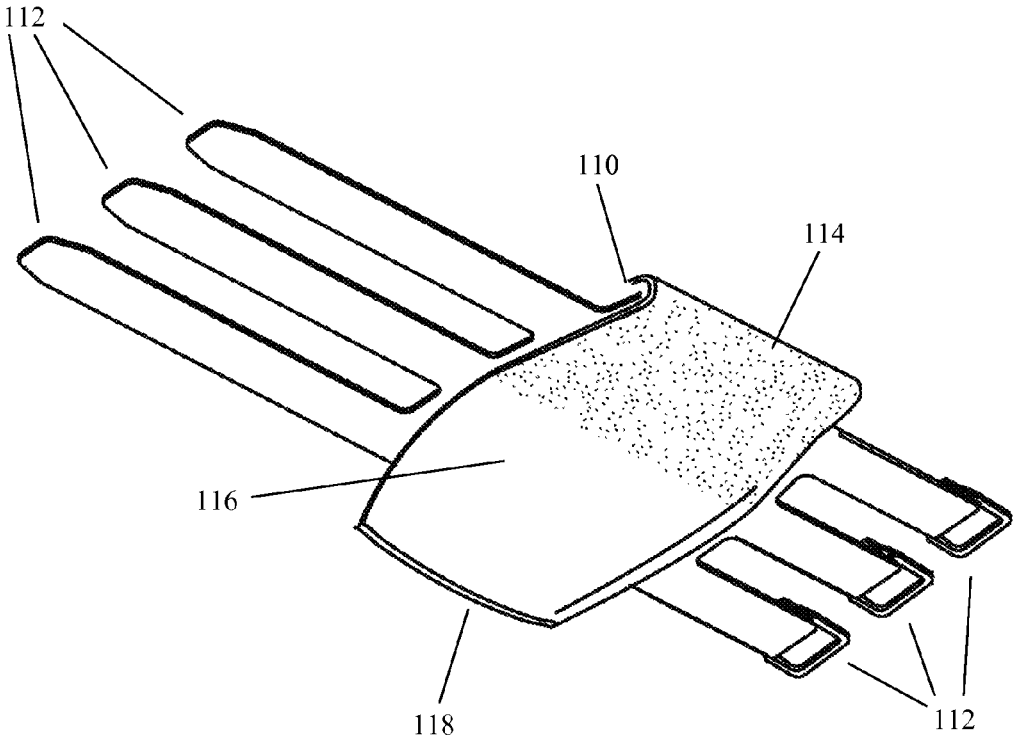
FIG. 9 is a bottom left perspective view of one embodiment of the device, wherein an abrasive surface for sanding is an integral part of the device.
Figure 10:
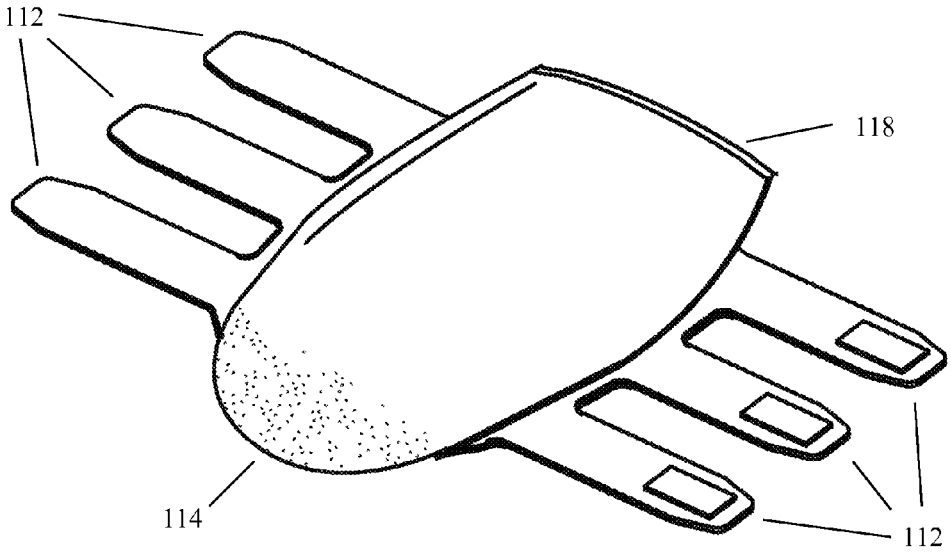
FIG. 10 is a perspective view of the top side of one embodiment of the device, wherein an abrasive surface for sanding is an integral part of the device and is wrapped around both the top and bottom sides of the device.
Figure 11:
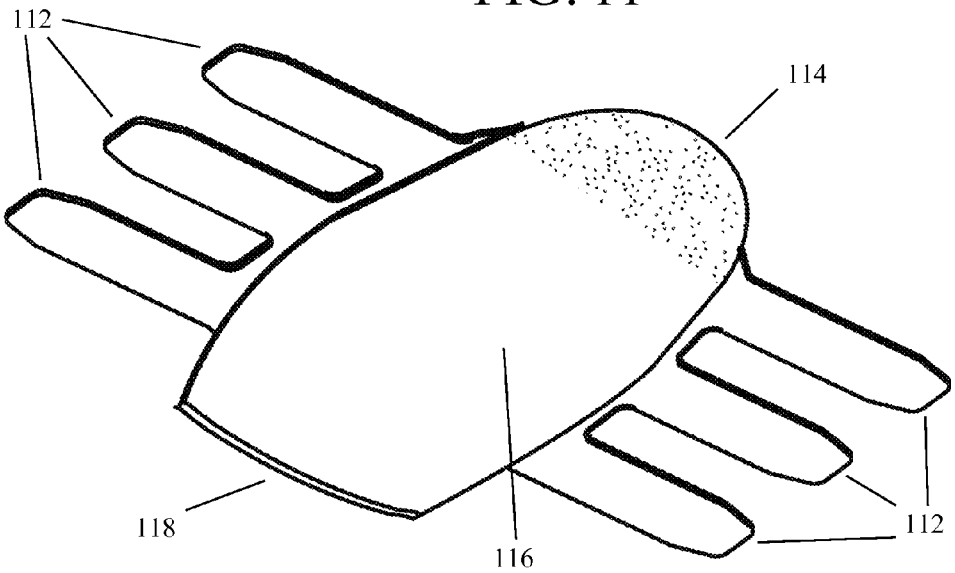
FIG. 11 is a perspective view of the bottom side of one embodiment of the device, wherein an abrasive surface for sanding is an integral part of the device and is wrapped around both the top and bottom sides of the device.

Once the hand is secured within the device and the optional insert is in place, the user can attach a surface treatment attachment or sanding surface 114 to the lower facing portion of the device 116, as illustrated in FIGS. 7 and 8. The sanding surface 114 would typically be sandpaper formed from a strong paper with a layer of sand or other abrasive on one of its surfaces, and can be of varying grits or grades. The sanding surface 114 can be attached by any known means to this lower facing portion of the device 116, but would ideally be attached to the device by adhesive or hook and loop. The sanding surface 114 may be shaped in such a way that conforms to the shape of the device, and may be reusable or disposable sheets. In some embodiments, the sandpaper or other abrasive sanding surface 114 may be permanently affixed to the lower facing portion of the device 116, and may be an integral part of the device, as illustrated in FIG. 9 through FIG. 11. In some embodiments, the sanding surface 114 may be permanently affixed to both the lower facing portion of the device 116 and the adjustable folding flap 110, as illustrated in FIG. 9. In some embodiments, the device may not include an adjustable folding flap, and the sanding surface 114 may be permanently affixed to the end portion of the device on either the lower facing portion of the device 116 or the upper facing portion of the device (not numbered), or on both the lower and upper facing portions of the device, as illustrated in FIG. 10 and FIG. 11.

With use of the sanding surface 114, the user can smooth various surfaces, such as flat surfaces, curved surfaces, angled surfaces, tight corners and other surfaces of varying kinds with precise hand and finger control, all with hand and fingers protected from abrasion and splinters. Smoothing or sanding may be done to facilitate application of various coatings, to render a surface safer for human skin contact, or to improve fit or function when attached to other objects or surfaces.

Figure 24:
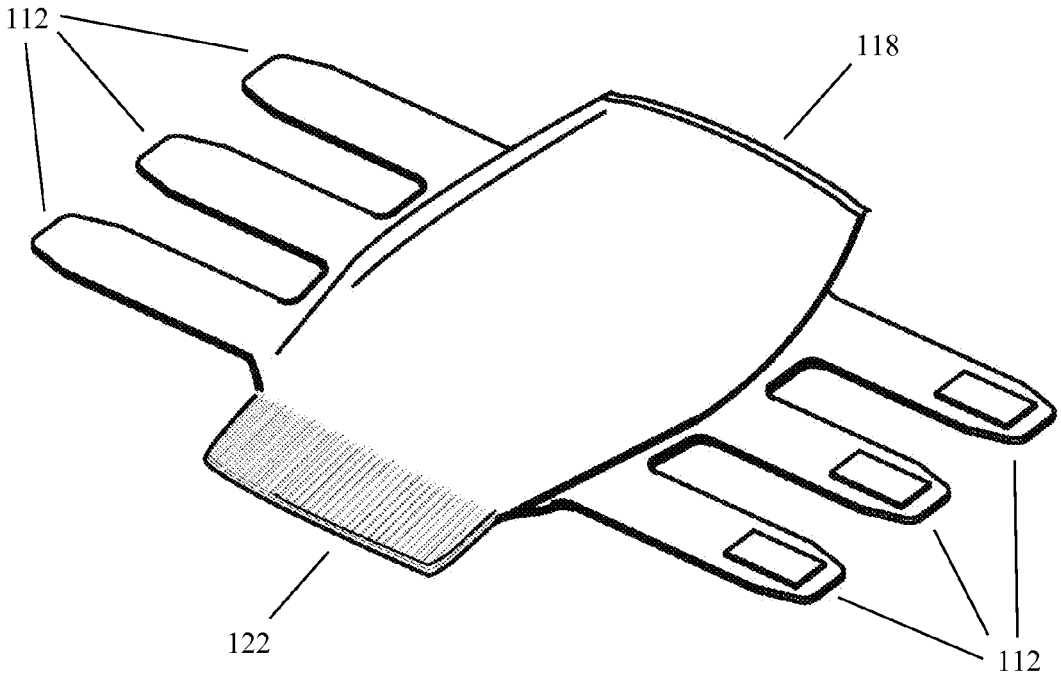
FIG. 24 is a perspective view of one embodiment of the device, wherein the device includes a brush attachment.
Figure 25:
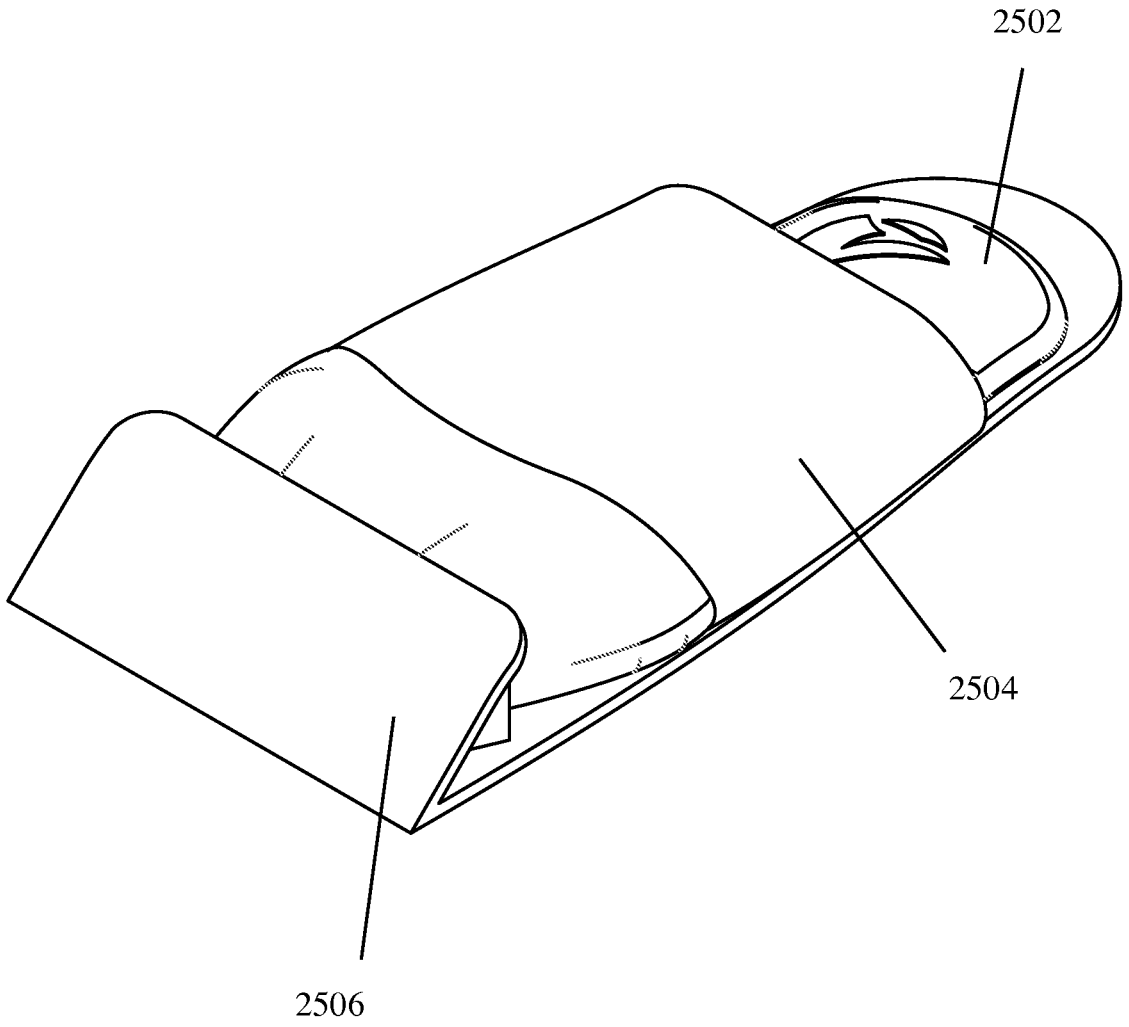
FIG. 25 is a front right perspective view of one embodiment of the device, wherein the sanding device includes a raised pad and grip area, an elastic wrist cover, and a rigid plate.
Figure 26:
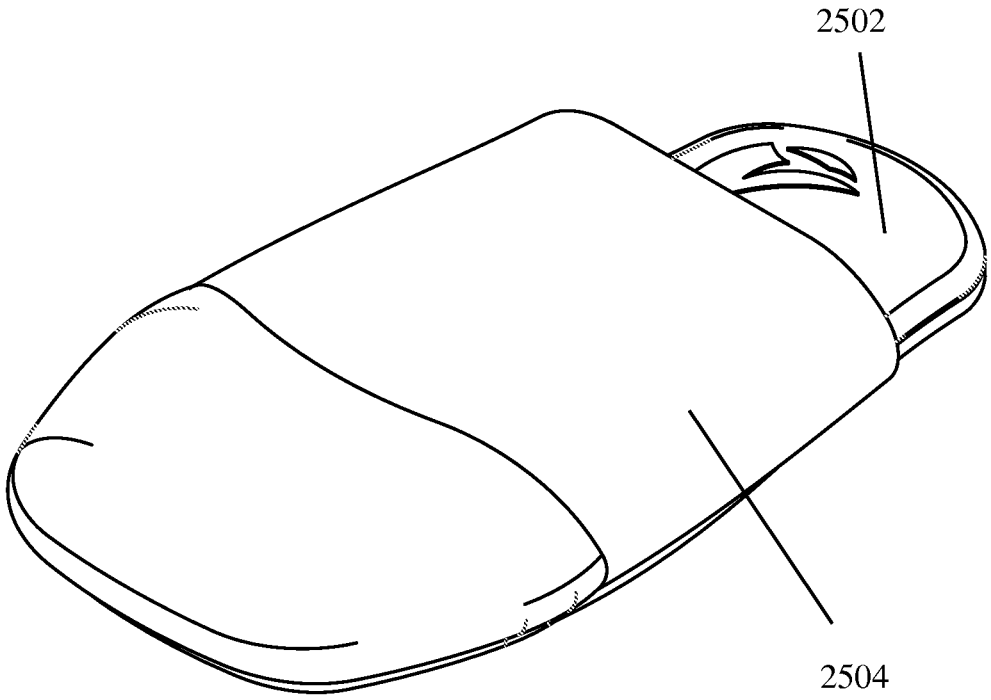
FIG. 26 is a front right perspective view of the device of FIG. 25 without the rigid plate.
Figure 27:
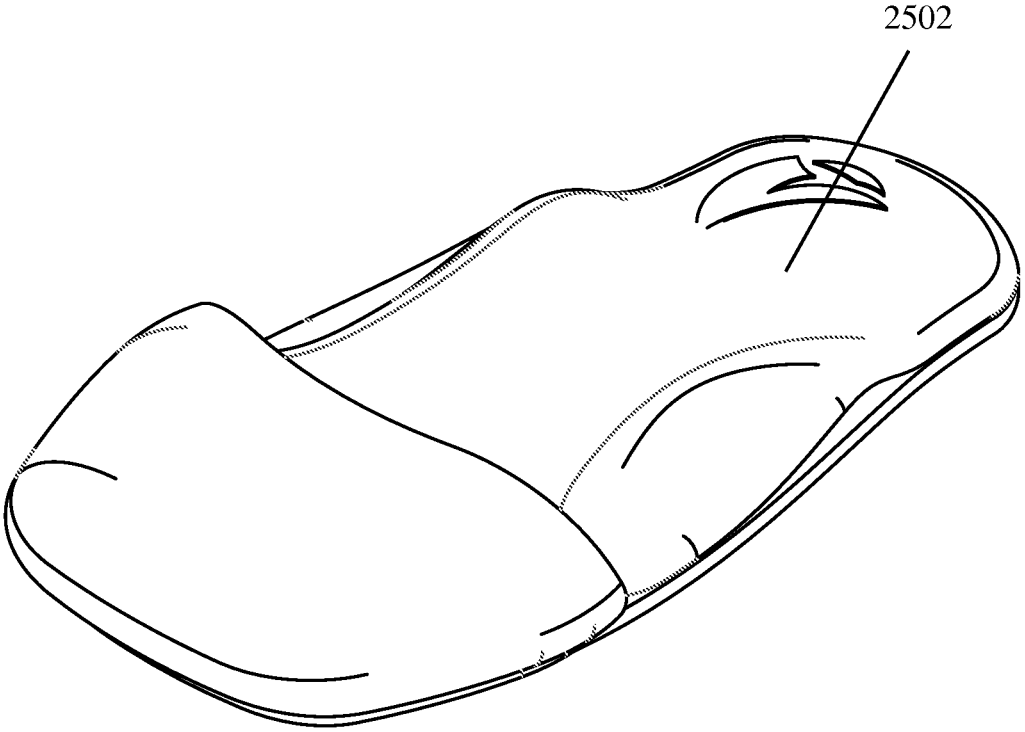
FIG. 27 is a front right perspective view of the raised pad and grip area of the device of FIG. 25.
Figure 28:
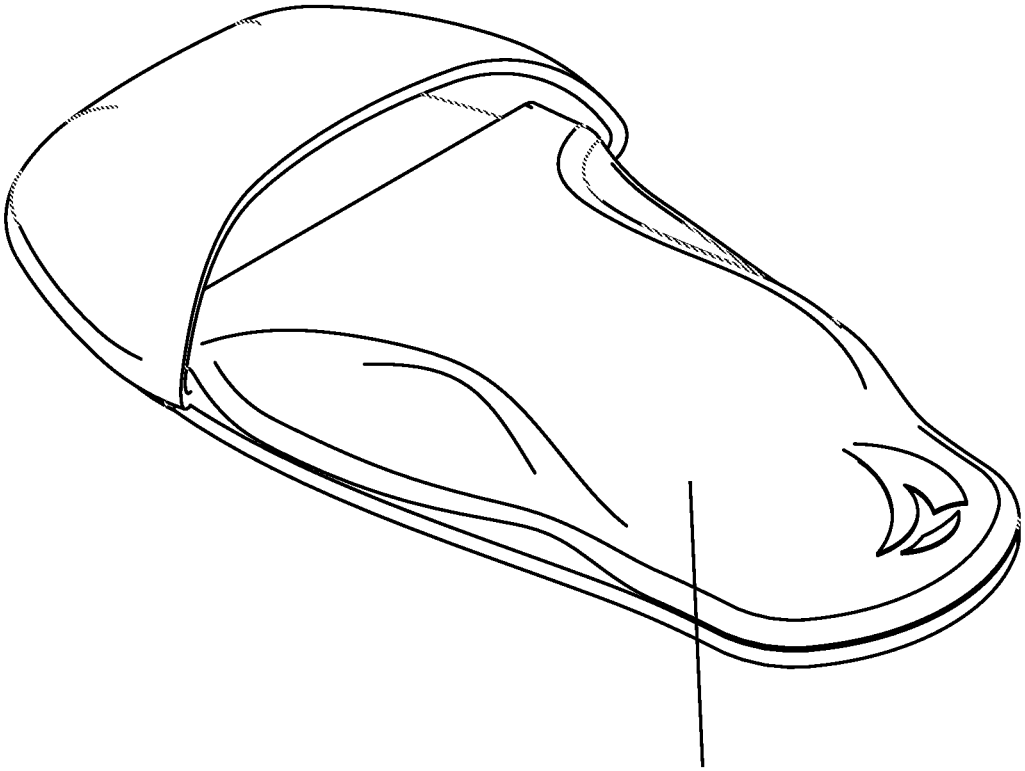
FIG. 28 is a back left perspective view of the raised pad and grip area of the device of FIG. 25.

The device may be used with surface treatment attachments other than the sanding surface 114 referenced above. For example, a user could attach a polishing material to treat or buff various kinds of surfaces. As a further example, a layer of semi-porous material could be attached to the lower-facing portion of the device to apply paint or stain to a surface. As a further example, a light abrasive material suitable for manual dermabrasion could be attached to the device for personal use or for use by a skincare specialist. Other attachments that may be used with the device include a sharp edge attachment, such as a knife blade or serrated edge saw-type blade, exposed to allow for cutting, scouring, scraping, or other uses. The device may further use a wire or fiber brush attachment 122, as illustrated in FIG. 24, for similar purposes. The device may further use a file end attachment in some embodiments.

Figure 12:
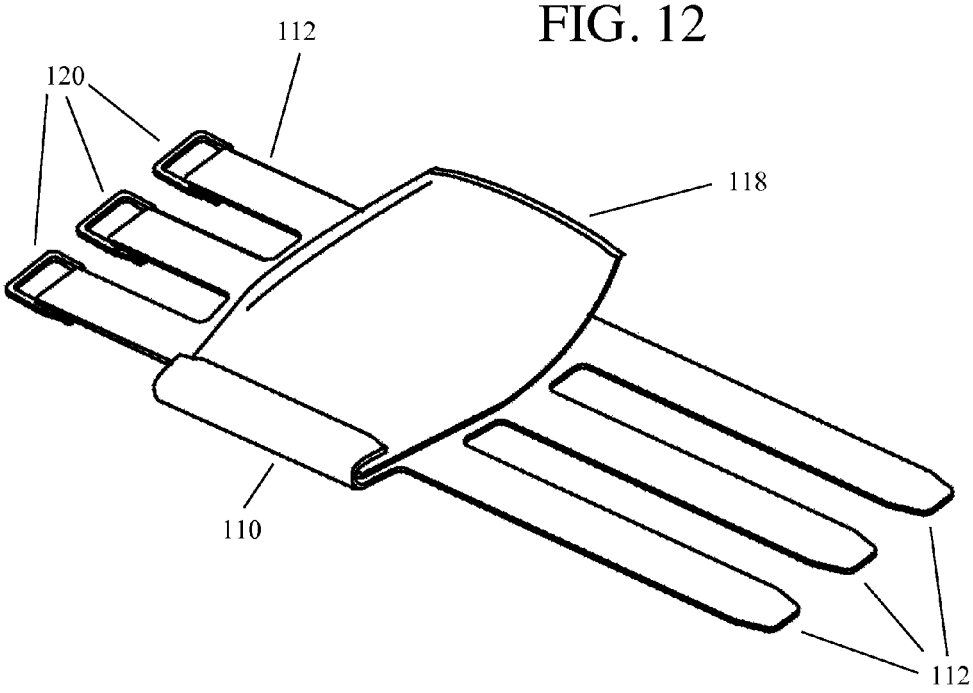
FIG. 12 is a front right perspective view of one embodiment of the device, wherein the device includes at least rigid buckle and/or at least one hook and loop closure strap and an elastic wristband.
Figure 13:
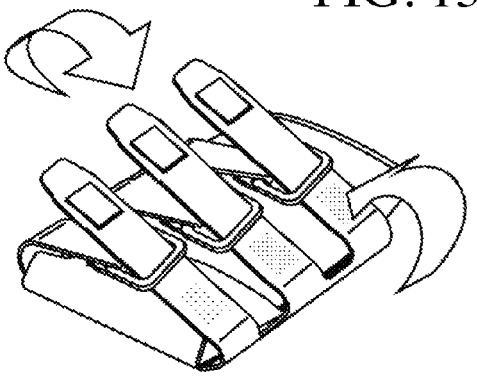
FIG. 13 is a front right perspective view of the device of FIG. 12.
Figure 14:
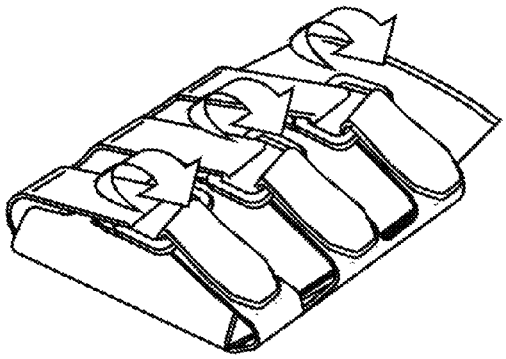
FIG. 14 is a front right perspective view of the device of FIG. 12.

Referring now to FIG. 12, the device may be secured around the hand of the user by other means than just the at least one closure strap 112. For example, the device may include an elastic wrist band 118 in some embodiments to naturally seal around the user's entire hand at the wrist. The at least one closure strap 112 may include a rigid buckle 120 to provide a folding, adjustable closure, as illustrated in FIG. 13 and FIG. 14. In some embodiments, the at least one closure strap 112 may be fastened using fabric hook and loop fasteners or similar material to provide a range of sizing adjustments. In some embodiments, wherein the device is made of a stretchable, form-fitting material, the device may not require the use of closure straps as the properties of the material may be such that the device is secured simply by placing the user's hand within the device and allowing the material to fit the form of the user's hand. In some embodiments, the device provides enclosure of not only a user's hand but also of the user's wrist. Such enclosure may provide protection or waterproofing of the user's wrist.

Figure 16:
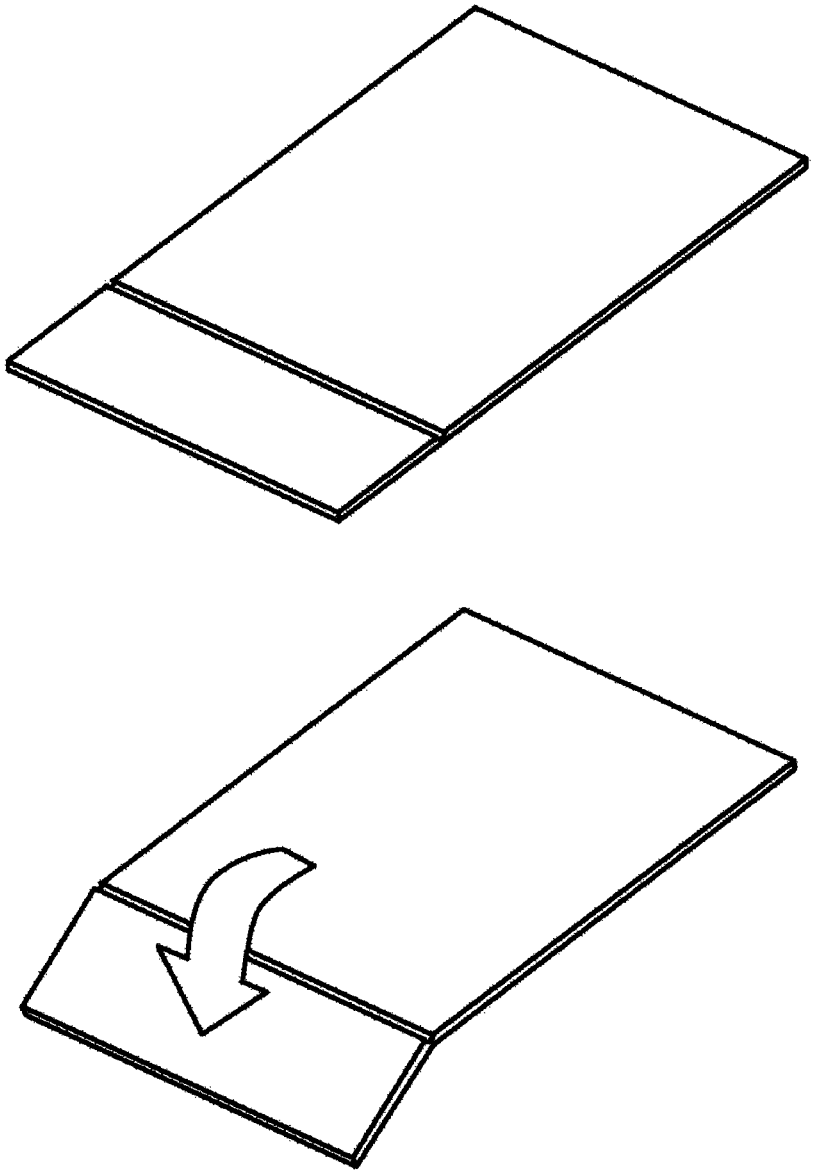
FIG. 16 is an illustration of a single-hinged, adjustable folding rigid edge insert according to one embodiment of the present invention.
Figure 17:
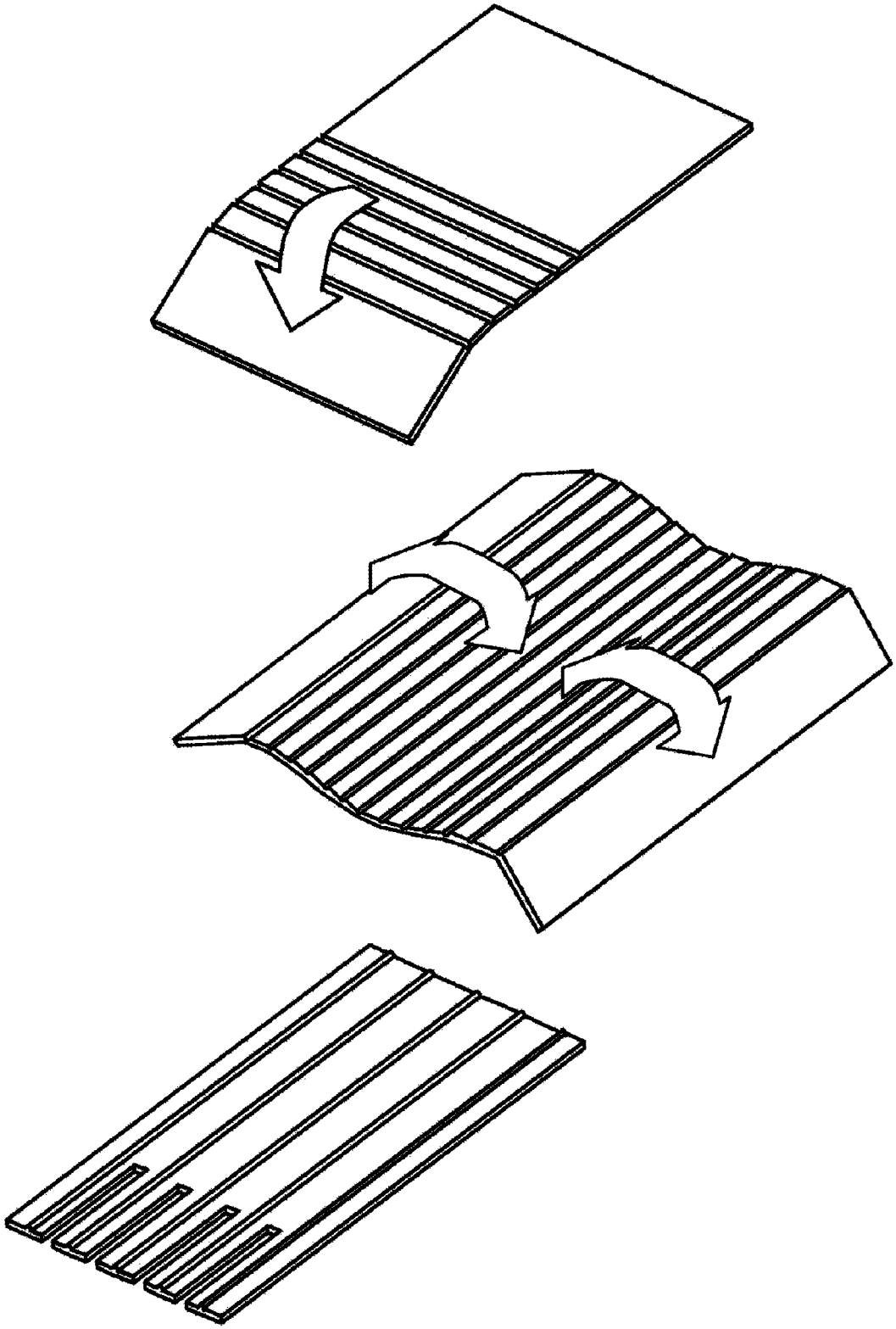
FIG. 17 is an illustration of example multiple-hinged, adjustable folding rigid edge inserts according to one embodiment of the present invention.
Figure 18:
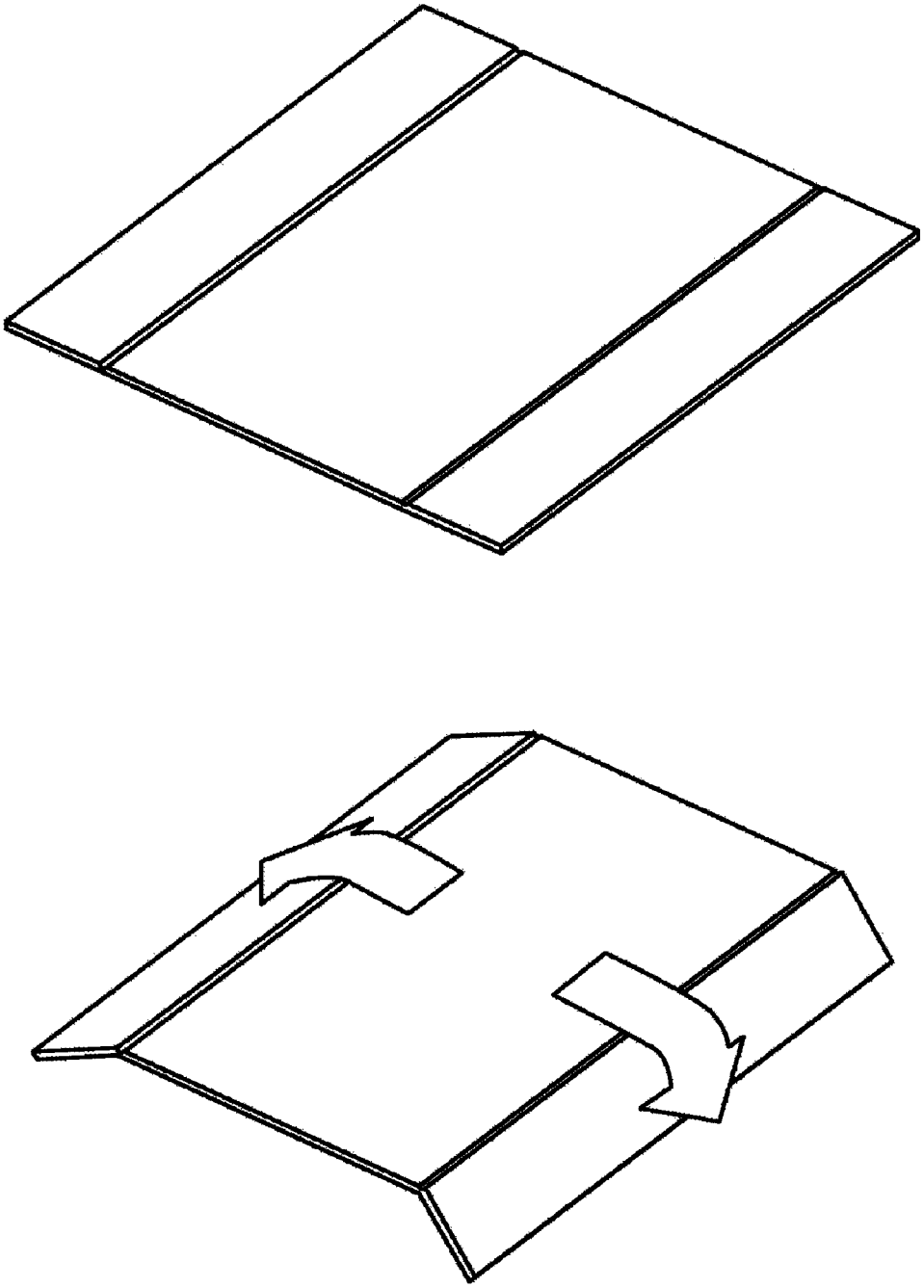
FIG. 18 is an illustration of a hinged rigid edge insert according to one embodiment of the present invention.

Referring to FIG. 15 through FIG. 18, the rigid edge insert 104 of the present invention may be any of a number of physical configurations. For example, as illustrated by FIG. 15, the rigid edge insert 104 may be flat, or have an edge that has an angled profile, for example, a 45 or 90 degree angle. In some embodiments, the rigid edge insert 104 may be hinged, adjustable and folding, as illustrated in FIG. 16. In some embodiments, the rigid edge insert 104 may be a multi-hinged insert, as illustrated in FIG. 17, providing customized shaping of the device edge while maintaining an extended rigid surface. The multiple hinges may run parallel to the left and ride side of the insert, or they may run perpendicular to the sides. In some embodiments, the rigid edge insert 104 may be hinged on one or both of its right and left sides rather than the edge, providing customized shaping by use of the user's thumb and/or fingers, as illustrated by FIG. 18. The aperture or undersleeve 108 may be configured in a shape to receive a specifically shaped rigid edge insert 104 or may be configured so as to receive a number of shaped rigid edge inserts 104.

Figure 19:
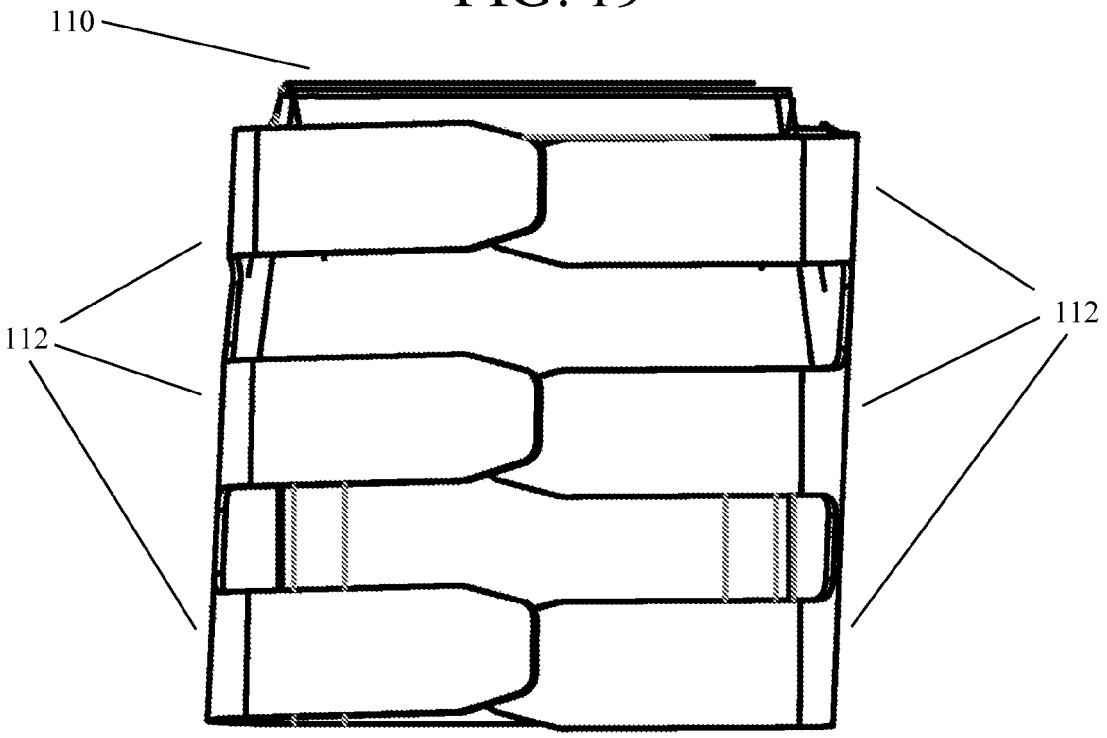
FIG. 19 is a top orthographic view of the folded device according to one embodiment of the present invention.
Figure 20:
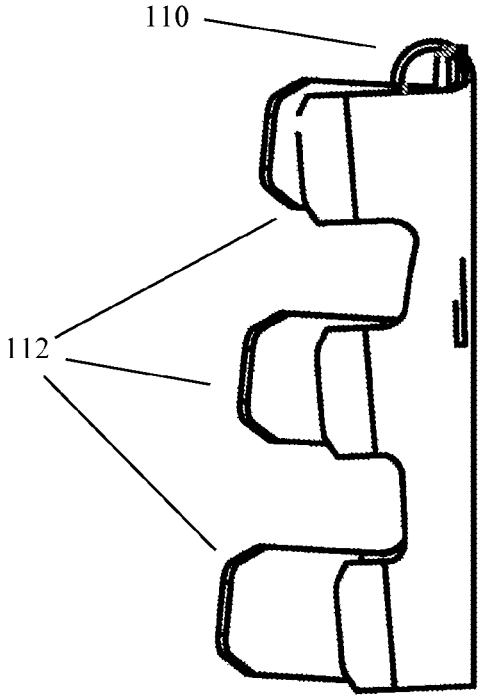
FIG. 20 is a side orthographic view of the folded device according to one embodiment of the present invention.
Figure 21:
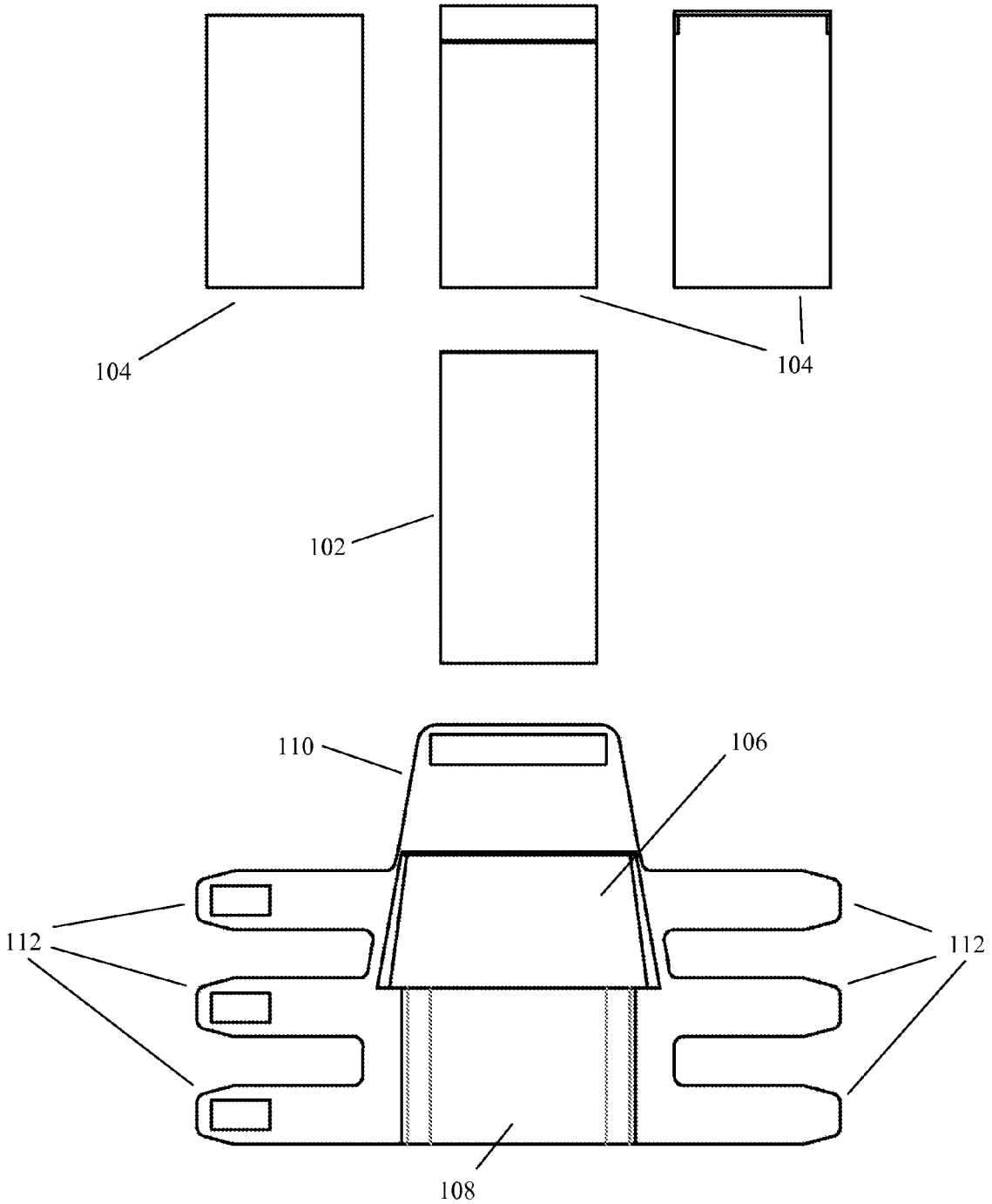
FIG. 21 is a top orthographic view of the unfolded device and various inserts according to one embodiment of the present invention.
Figure 22:
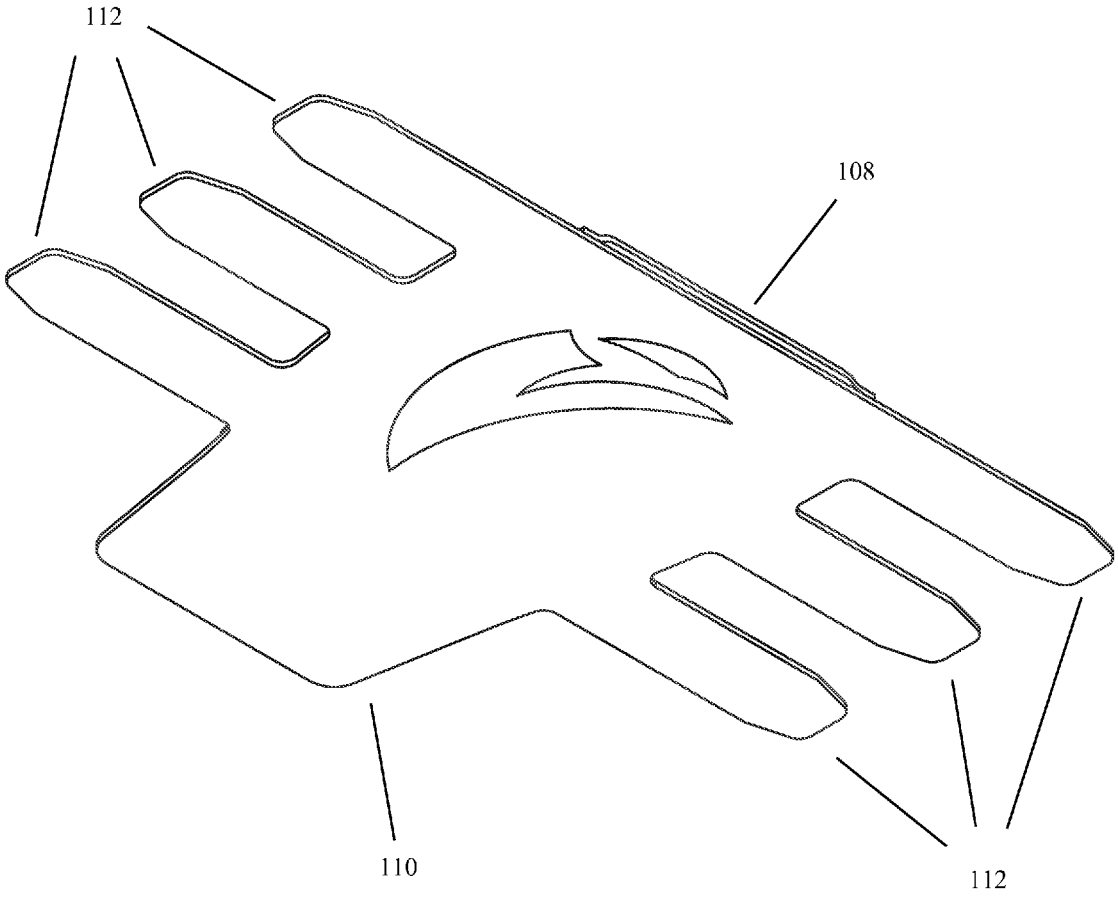
FIG. 22 is a bottom left perspective view of the unfolded device according to one embodiment of the present invention.
Figure 23:
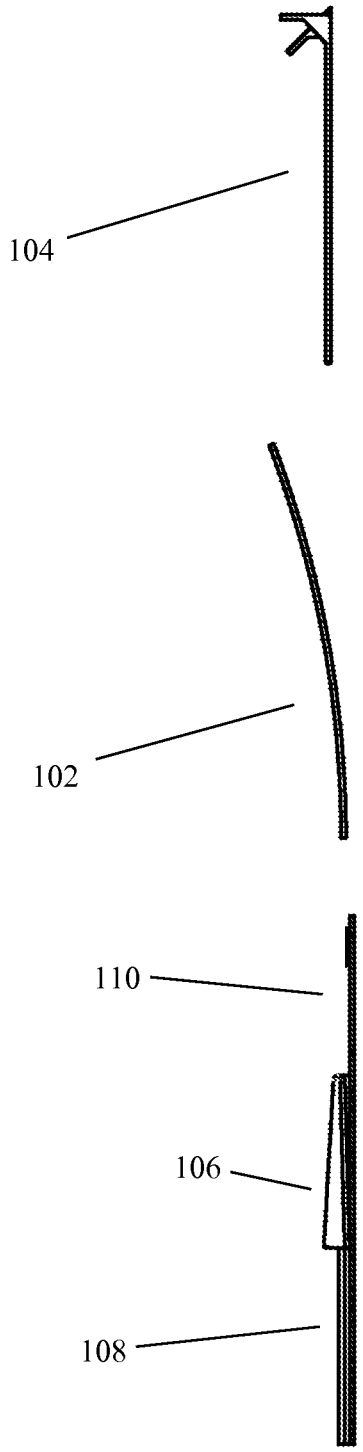
FIG. 23 is a side orthographic view of the unfolded device and various inserts according to one embodiment of the present invention.
Figure 45:
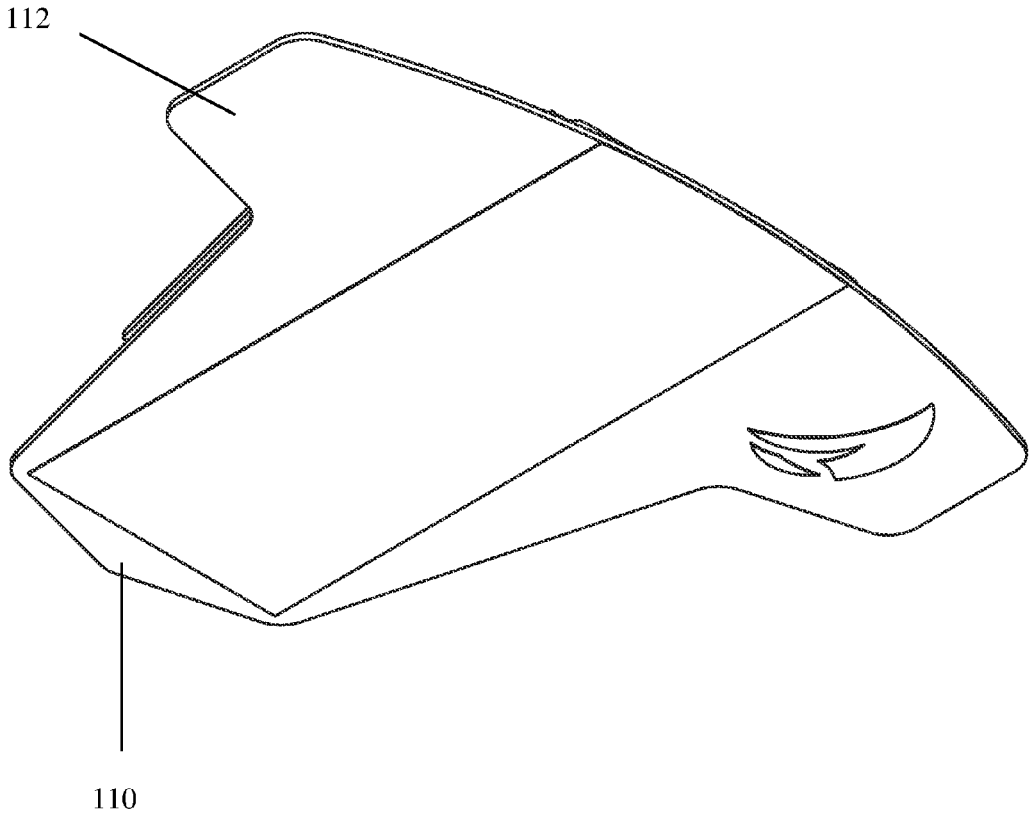
FIG. 45 is bottom perspective view of the unfolded device of FIG. 44 according to one embodiment of the present invention.

FIG. 19 is a top orthographic view of the device of FIG. 1 when it is folded. FIG. 20 is a side orthographic view of the device of FIG. 1 when it is folded. FIG. 21 is a top orthographic view of the device of FIG. 1 when it is unfolded, and also shows the various inserts used in conjunction with the device. FIG. 22 is a bottom perspective view of the device of FIG. 1 when it is unfolded. FIG. 23 is a side orthographic view of the device of FIG. 1 when it is unfolded, and also shows side orthographic views of the various inserts used in conjunction with the device. FIG. 45 is a bottom perspective view of the device of FIG. 44 when it is unfolded.

The various embodiments described above are provided by way of illustration only and should not be construed to limit the claims attached hereto. Those skilled in the art will readily recognize various modifications and changes that may be made without following the example embodiments and applications illustrated and described herein and without departing from the true spirit and scope of the following claims.

What is claimed is:

1. A wearable surface treatment device, comprising:

a base comprising a roughly rectangular flat bottom, a top, a leading edge, a back edge, a first side edge, and a second side edge;

the base including a folding flap located at the leading edge;

an aperture forming a pocket located between the roughly rectangular flat bottom of the base and the top of the base;

at least one enclosure strap fixedly attached to the first side edge and removably attached to the second side edge that wraps across a top part of a user's hand;

a removable, roughly rectangular, rigid layer having a leading edge, a back edge, and two side edges, the rigid layer located within the pocket that extends the length of the base; wherein the rigid layer has a plurality of hinges allowing the rigid layer to bend along the plurality of hinges, the hinges running either parallel to the side edges and extending the length of the rigid layer or running perpendicular to the side edges and extending the entire width of the rigid layer; and a removable abrasive layer located on the roughly rectangular flat bottom of the base;

wherein the folding flap wraps around at least a portion of the leading edge of the base.

2. The device of claim 1, wherein the rigid layer is a removable rigid edge insert.

3. The device of claim 1, wherein the rigid layer has an angled end portion.

4. The device of claim 3, wherein the angled end portion has an angle of 90 degrees.

5. The device of claim 3, wherein the angled end portion has an angle of 45 degrees.

6. The device of claim 1, wherein the top of the base is a molded pad configured to conform to the shape of the user's palm.

7. The device of claim 6, wherein the folding flap has recessed areas for the user's fingers.

8. The device of claim 1, further comprising a fingertip pocket located at the leading edge of the base and configured to receive fingertips of the user.

9. The device of claim 1, further comprising a removable insert pad located within the aperture.

10. The device of claim 1, wherein the removable surface treatment layer is additionally located on the folding flap.

11. A wearable surface treatment device, comprising:

a base comprising a flat bottom, a molded top configured to conform to the shape of a user's palm, a leading edge, a back edge, a first side edge, and a second side edge;

the base including a folding flap located at the leading edge;

an aperture forming a pocket located between the flat bottom of the base and the top of the base;

three enclosure straps fixedly attached to the first side edge and removably attached to the second side edge that wrap across a top part of the user's hand;

a removable, roughly rectangular, rigid layer having a leading edge, a back edge, and two side edges, the rigid layer located within the pocket that extends the length of the base, wherein the rigid layer has a plurality of hinges allowing the rigid layer to bend along the plurality of hinges, the hinges running either parallel to the side edges and extending the length of the rigid layer or running perpendicular to the side edges and extending the entire width of the rigid layer; and a removable sandpaper layer located on the flat bottom of the base;

wherein the folding flap wraps around at least a portion of the leading edge of the base and has recessed areas for the user's fingers.

* * * * *

UNITED STATES PATENT AND TRADEMARK OFFICE

CERTIFICATE OF CORRECTION

PATENT NO. : 9,017,149 B2
APPLICATION NO. : 14/259572
DATED : April 28, 2015
INVENTOR(S) : Helmut H. Mauer It is certified that error appears in the above-identified patent and that said Letters Patent is hereby corrected as shown below:

In the specification:

Column 1, line 12 should read as follows:
--The present disclosure is related to...--

Column 5, line 21 should read as follows:
--...can be flat and can have an end...--

Column 5, line 31 should read as follows:
--...insert pad 102 can be made of...--

Column 5, line 42 should read as follows:
--...edge that is flat or may have...--

Column 5, line 54 should read as follows:
--...edge of the device and further...--

Column 6, line 17 should read as follows:
--...to ensure a snugger fit. Further, the...--

Column 6, lines 18-19 should read as follows:
--...hand through the use of a tab 2902...--

Column 6, lines 19-20 should read as follows:
--...outside of the device by a hook and pull...--

Column 7, line 3 should read as follows:
--...portion of the device 116 and may...--

Signed and Sealed this
Eighth Day of March, 2016

Michelle K. Lee

Michelle K. Lee
*Director of the United States Patent and Trademark Office*

In the specification:

Column 7, lines 11-12 should read as follows:
--...on the lower facing portion of the device 116, the upper facing...--

Column 7, line 59 should read as follows:
--...may be flat or have an edge...--

Column 8, line 13 should read as follows:
--...when it is unfolded and also shows...--